United States Patent [19]

Harvey, Jr.

[11] 4,045,001

[45] Aug. 30, 1977

[54] PUMPING RATCHET WINCH

[76] Inventor: Thomas G. Harvey, Jr., 2385 Bossert Ave., Kamloops, British Columbia, Canada, V2B 4V6

[21] Appl. No.: 594,585

[22] Filed: July 10, 1975

[51] Int. Cl.[2] ..... B66D 1/00

[52] U.S. Cl. ..... 254/164; 254/73; 242/157.1

[58] Field of Search ..... 254/161, 164, 167, 163, 254/186 AC, 150 R, 73, 127, 190 R; 74/524, 148; 105/477; 242/158 R, 86.8, 84.43, 157.1, 86.62; 24/115 R

[56] References Cited

U.S. PATENT DOCUMENTS

| | | | |
|---|---|---|---|
| 1,151,349 | 8/1915 | Flegel | 242/84.43 |
| 1,195,776 | 8/1916 | Burnham | 254/161 |
| 1,833,484 | 12/1931 | Geer | 254/167 |
| 2,083,489 | 6/1937 | Benson | 254/186 HC |
| 2,363,138 | 11/1944 | Moore | 254/164 |
| 2,660,382 | 11/1953 | Wilson | 242/158 R |
| 2,913,224 | 12/1959 | Uhlig | 254/164 |
| 3,158,108 | 12/1964 | Sharp | 254/164 |
| 3,458,153 | 7/1969 | Lawrence | 242/159 R |
| 3,602,065 | 8/1971 | Ratcliss | 254/167 |
| 3,804,368 | 4/1974 | Bailey | 254/164 |

FOREIGN PATENT DOCUMENTS

| | | | |
|---|---|---|---|
| 936,089 | 9/1963 | United Kingdom | 242/86.8 |

*Primary Examiner*—Robert J. Spar
*Assistant Examiner*—Kenneth Noland
*Attorney, Agent, or Firm*—Robert W. Beach

[57] ABSTRACT

The handle arm of a ratchet winch is convertibly connectible to the ratchet drive lever either to provide a stiff arm swingable conjointly with the ratchet drive lever relative to the winch frame for high-speed operation of the winch, or to provide a pumping arm rockable relative to the ratchet drive lever and engageable with the frame to pry the ratchet drive lever and swing it incrementally relative to the winch frame for high-power operation of the winch. The winch can be anchored by a tie bridging across the winch frame. Wire rope is led onto the winch drum by a traveling fairlead.

21 Claims, 48 Drawing Figures

Fig. 4.
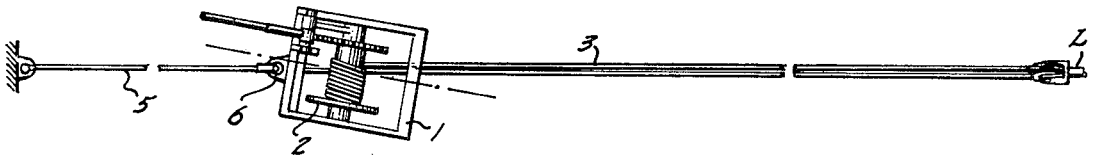
Fig. 5.
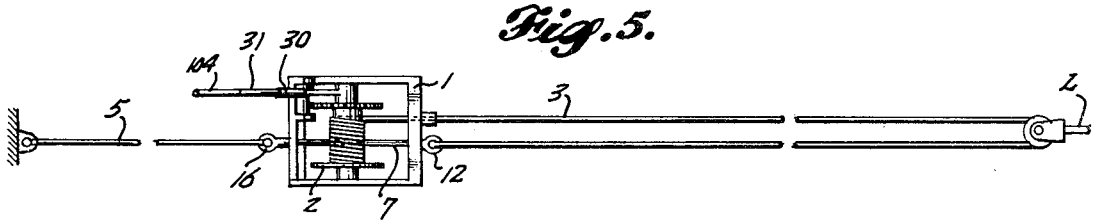
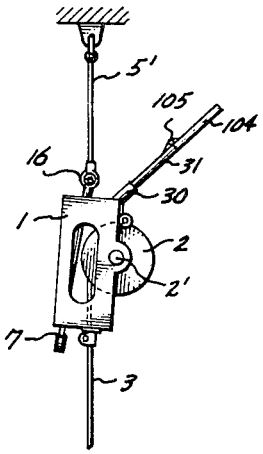
Fig. 6.
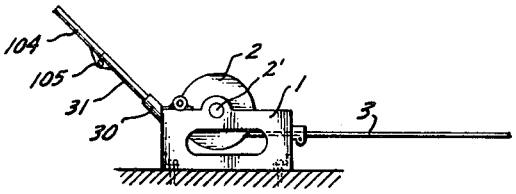
Fig. 1.
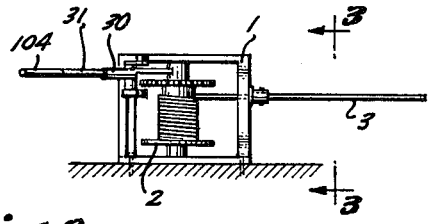
Fig. 2.
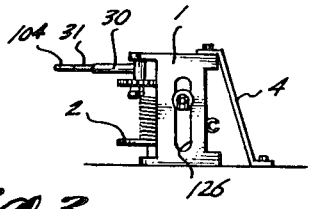
Fig. 3.

129
127
132
3
131
123
21
2
126
12
20
22
40
84
46
42
104
85
28
31
48
27
2'
49
105
106
51
45
44
16
52
26
1
53
62
30
24
29
23

104
105
106
123
3
127
131
31
30
2
126
12
20
84
41
55
68
29
42
54
21
28
85
27
26
46
66
65
32
2'
48
10
49
51
45
23
52
44
16
53
25
1
62
24

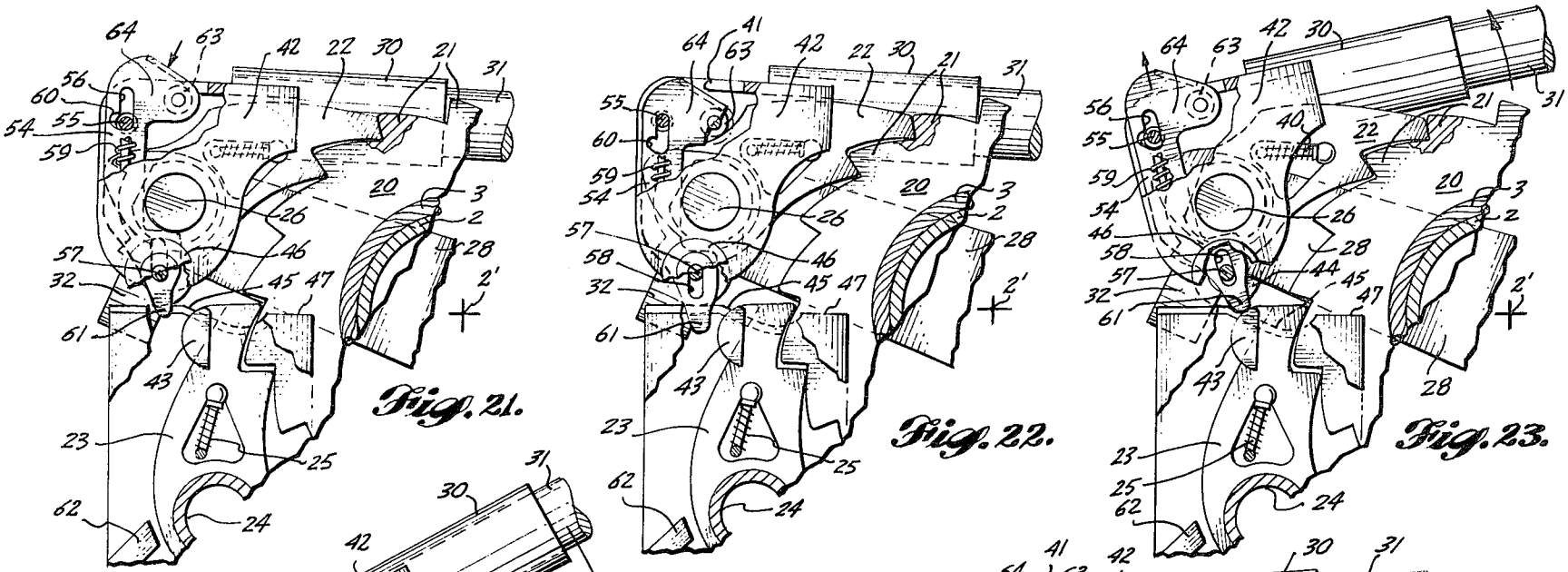
Fig. 21.
Fig. 22.
Fig. 23.
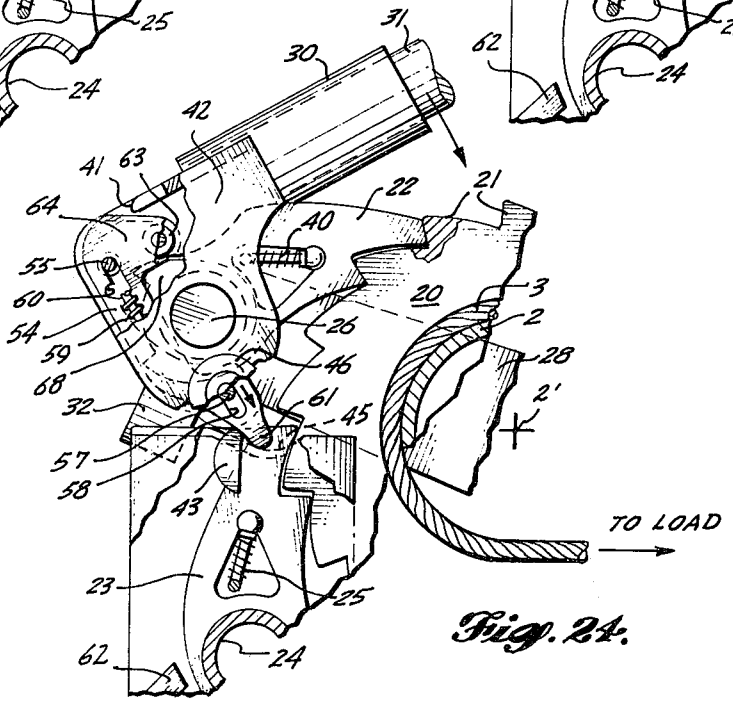
Fig. 24.
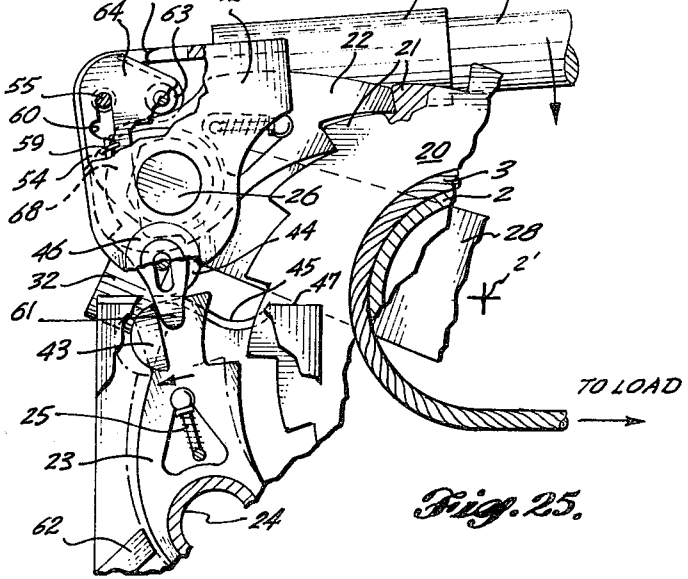
Fig. 25.

Fig. 32.
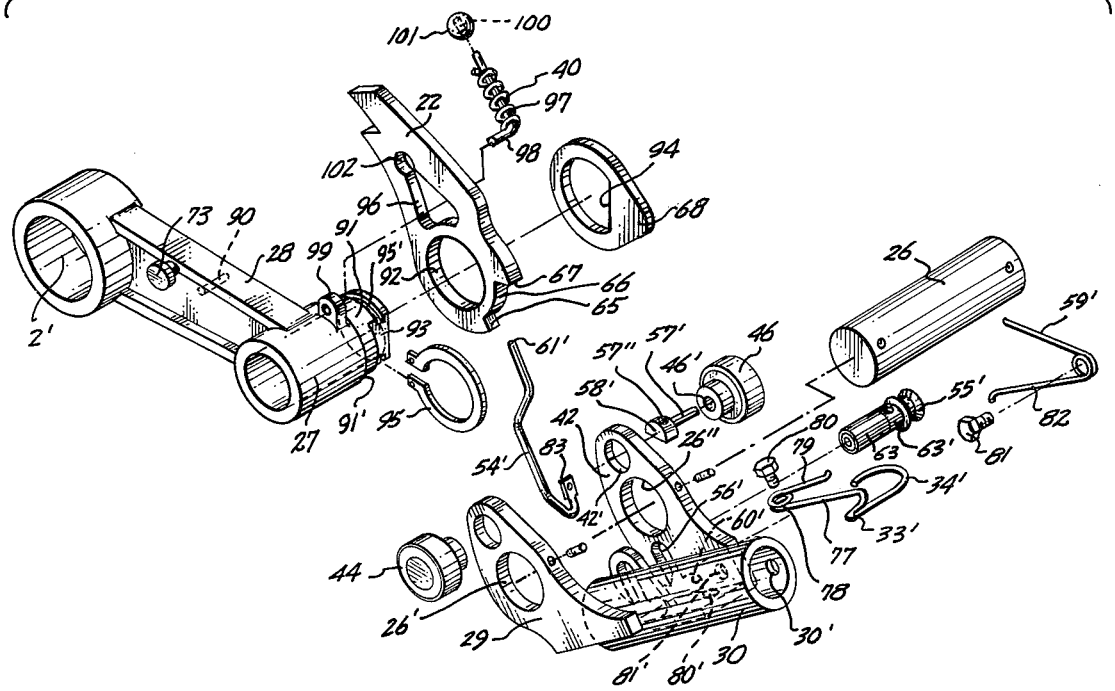
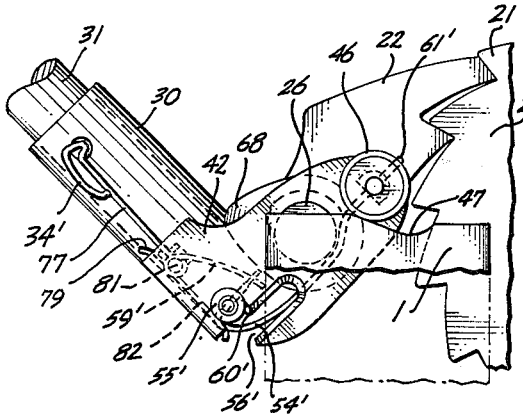
Fig. 31.
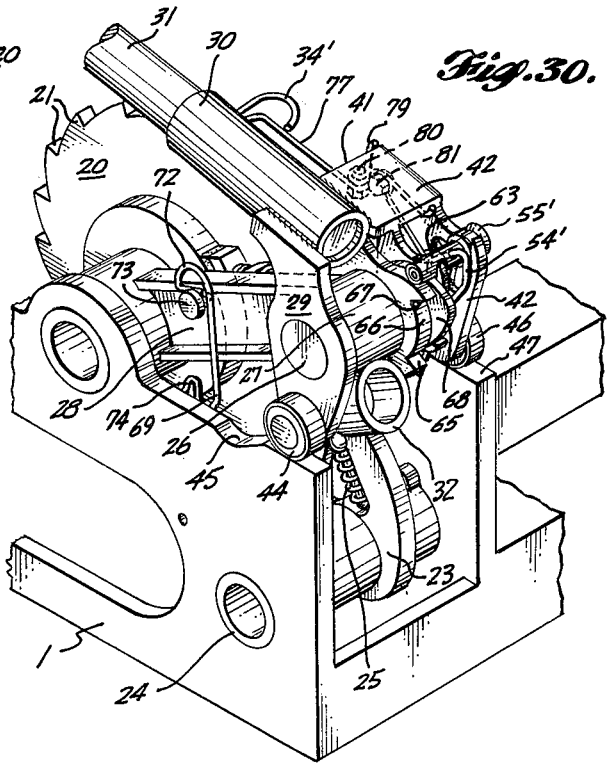
Fig. 30.

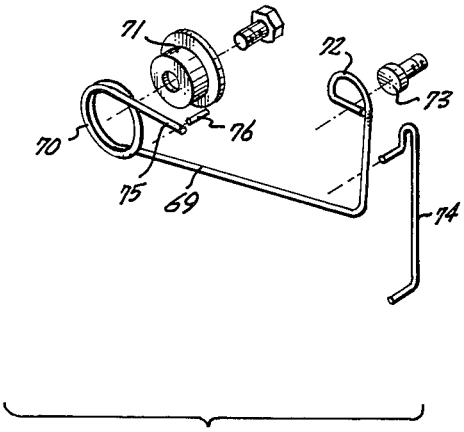
Fig. 36.
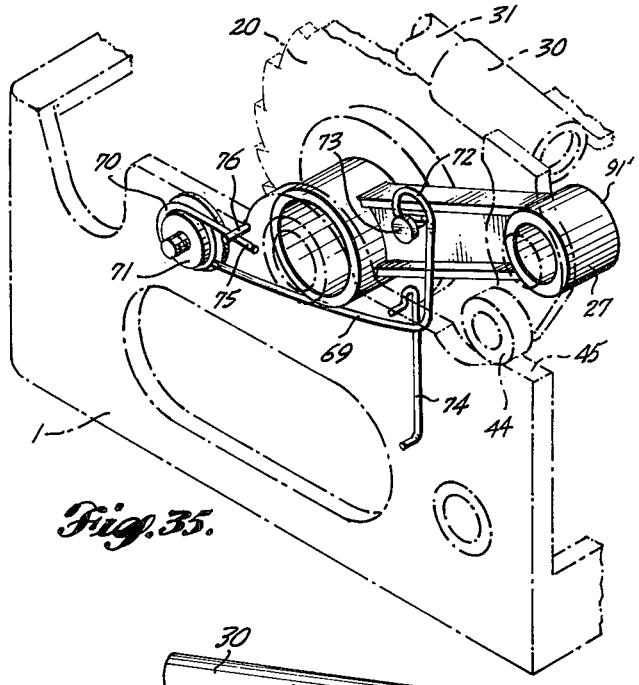
Fig. 35.
Fig. 34.
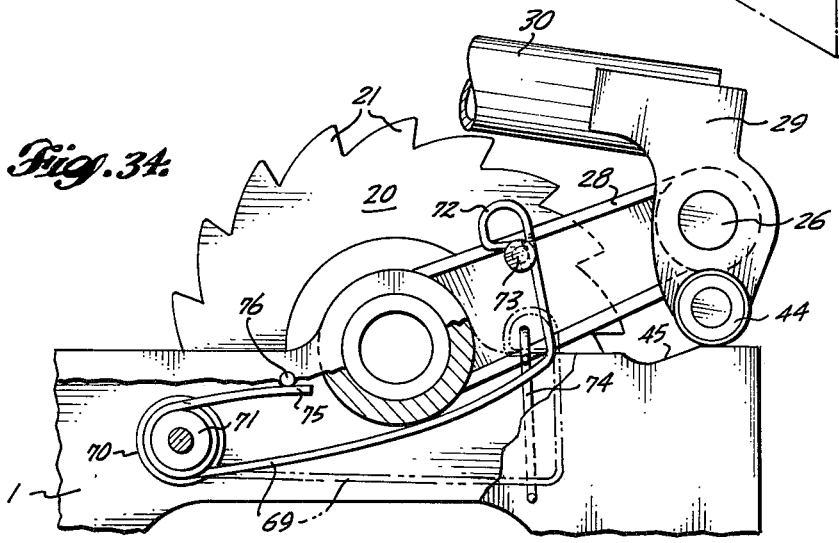
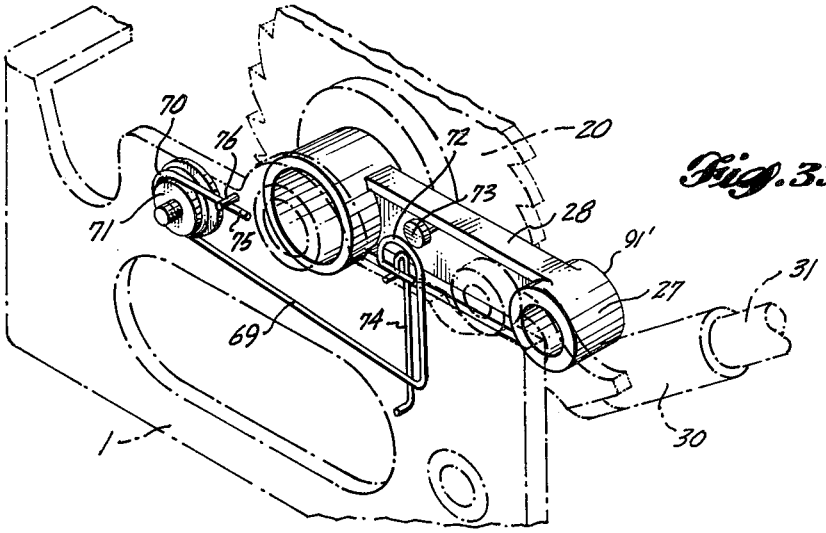
Fig. 33.

Fig. 46.
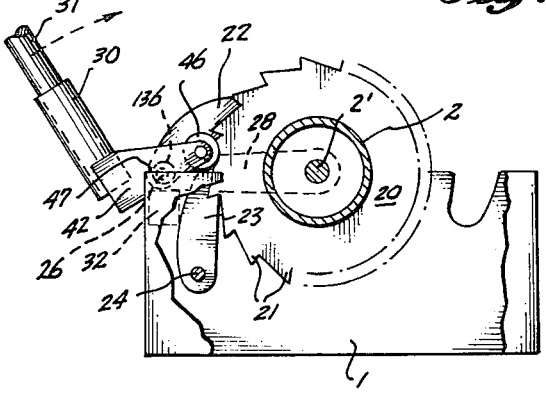
Fig. 44.
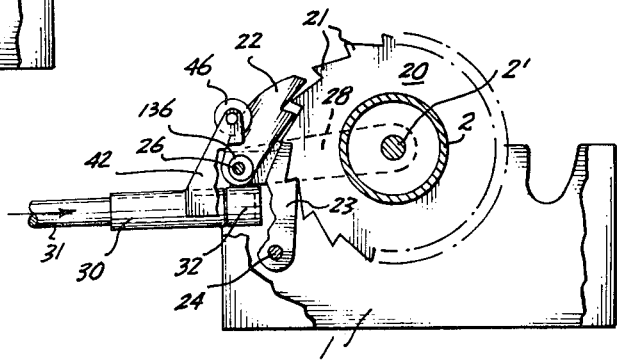
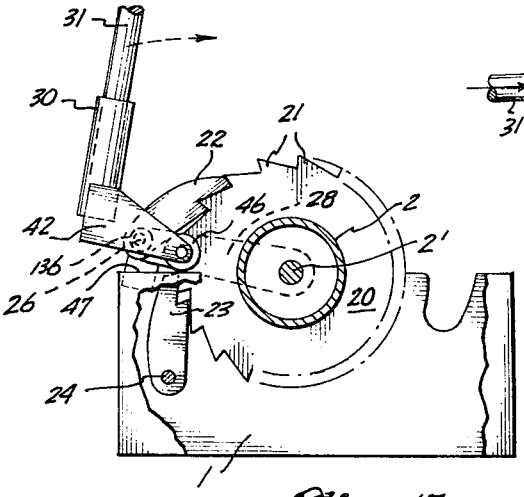
Fig. 47.
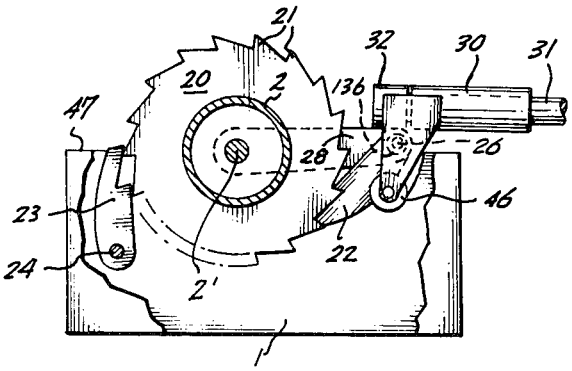
Fig. 45.
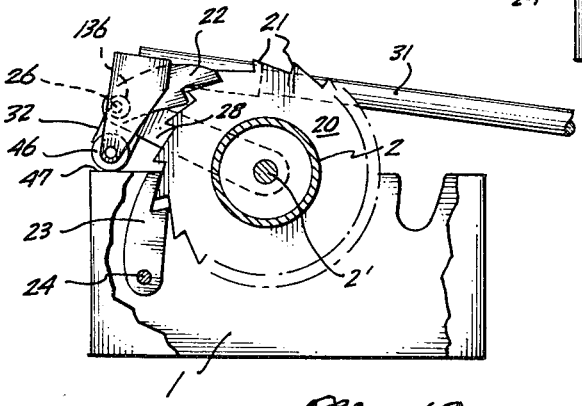
Fig. 48.

PUMPING RATCHET WINCH

BACKGROUND OF THE INVENTION

Field of the Invention

This invention relates to a manually operable winch of the ratchet type which can be converted readily for high-speed operation or for high-power operation.

SUMMARY OF THE INVENTION

A principal object of the invention is to provide a manually operable winch which is sufficiently compact and light as to be portable while being strong and capable of exerting a very powerful pull by the exertion of reasonable effort.

Another object is to provide such a winch which is versatile in that is can be mounted in various ways and in various attitudes.

In mounting the winch it is an object to be able to anchor it securely without it being subjected to a force during its operation which will cock the drum so as to deter even winding of the winch line on it.

A further object of the invention is to provide a manually-operable winch which can be converted quickly and easily between a high-speed operating condition and a highpower operating condition with minimum interruption in operation of the winch and irrespective of the load to which the winch is subjected at the time of connversion.

BRIEF DESCRIPTION OF THE DRAWINGS

FIG. 1 is a somewhat diagrammatic side elevation of the winch.

FIG. 2 is a somewhat diagrammatic side elevation of the winch turned on its side relative to the illustration of the winch in FIG. 1, and FIG. 3 is an elevation looking in the direction indicated by line 3—3 in FIG. 2.

FIGS. 4 and 5 are plans of the winch illustrating additional anchoring arrangements.

FIG. 6 is a side elevation of the winch mounted in another attitude.

FIGS. 17 to 29 are fragmentary elevations with parts broken away and having parts shown in different operating positions. FIGS. 17 to 20 illustrate high-power haul-in sequence; FIGS. 21 to 23 illustrate transition sequence from haul-in to pay-out; and FIGS. 24 to 29 illustrate high-power pay-out sequence.

FIG. 30 is a top perspective of a portion of the winch with some alternative features and FIG. 31 is a fragmenary side elevation of such winch portion with parts in different positions and with other parts broken away,.

FIG. 32 is a top perspective of parts of the winch shown in FIG. 30 in exploded relationship.

FIG. 33 is a top perspective of mechanism similar to that shown in FIG. 30, with parts in phantom.

FIGS. 34 and 35 are a side elevation and a top perspective, respectively, of a portion of the mechansim shown in FIG. 33, with parts in a different position.

FIG. 36 is a top perspective of parts of the winch mechanism shown in FIG. 35 in exploded relationship.

FIGS. 44 to 48, inclusive, are somewhat diagrammatic side elevations with parts broken away, showing a modified form of the invention.

DETAILED DESCRIPTION

Figure 10:
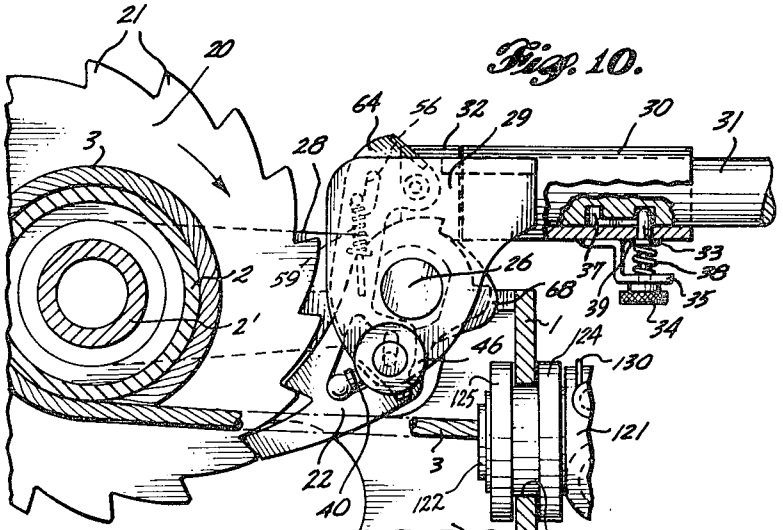
FIGS. 9 and 10 are fragmentary enlarged detail vertical sections of a portion of the winch taken on line 9—9 of FIG. 11, parts being broken away, and other parts being shown in different high-speed haul-in operating positions.

The winch can be made in various sizes, but the hauling capability of the winch is comparatively great for any given size. The compact frame 1 is approximately square. The drum 2 is rotatively mounted on an axle 2' mounted in the frame for the purpose of hauling in and paying out the hauling line 3.

WINCH ANCHORING

The winch can be mounted in various attitudes. FIG. 1 shows the winch frame as being bolted to a support with the axle 2' disposed parallel to the mounting surface of the support, which axle would usually be horizontal. FIG. 2 shows a side of the winch frame as being bolted to the support so that the axle 2' extends perpendicular to the surface of the support, which axle would normally be vertical. FIG. 3 shows a brace 4 connecting the winch frame and the support to deter tipping of the frame.

In FIGS. 4, 5 and 6 the winch is shown as being restrained from movement lengthwise of the hauling line 3 by an anchor tie instead of the frame being secured rigidly to a support. In FIG. 4 the anchor tie 5 is secured to an ear 6 projecting from the rear of the frame. Also the hauling line 3 is doubled so that one stretch extends from the drum 2 to the load L and the end of the return stretch is anchored to the ear 6. The difficulty with this arrangment is that the forces on the hauling line would tend to maintain the location at which the line leaves the drum 2 in registration with the return stretch of the line as shown in FIG. 4. Consequently, as the location at which the line leaves the drum moves back and forth along the length of the drum, the winch frame 1 would swing from side to side about the anchor point provided by the ear 6.

Figure 8:
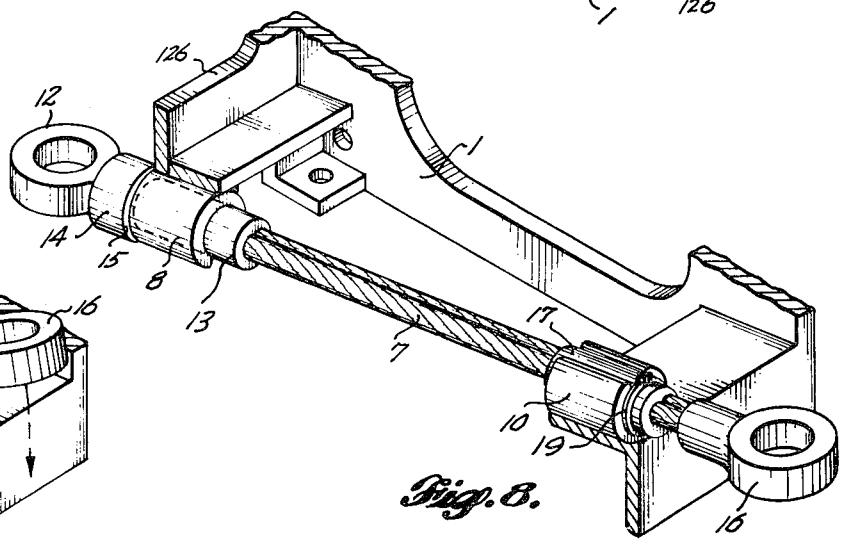
FIGS. 7 and 8 are enlarged fragmentary top perspectives of winch anchor mechanism anchoring the winch in FIG. 5.
Figure 7:
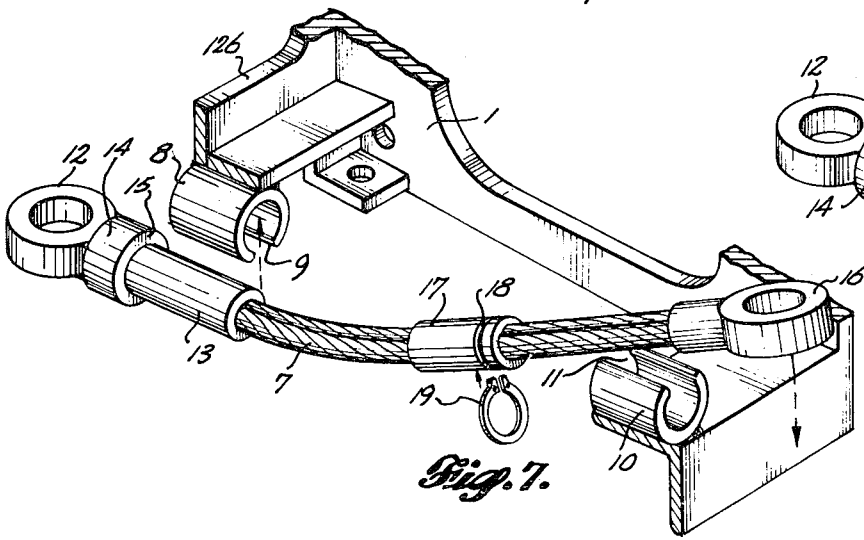

To prevent the stretch of the hauling line leaving the drum of the winch from exerting a force on the winch which would tend to cock the winch, a tie 7 bridging across the frame of the winch can be interposed between and conected to the anchor tie 5 and the anchored end of the hauling line independently of the frame, as shown in FIG. 5. This bridging tie can be constructed and removably mounted on the winch frame 1 as shown in FIGS. 7 and 8.

The bridging tie 7 includes a stretch of wire rope of a length greater than the length of the winch frame 1. Preferably such wire rope stretch includes two parallel pieces of wire rope, each of a size corresponding to the size of the wire rope used for the hauling line 3 so as to be sure that the bridging tie can withstand as great a tension force as the working load for the doubled hauling line. One end portion of the wire rope stretch can be inserted into a collar 8 secured to the winch frame through a slot 9 in the lower side of the collar and extending axially of such collar. The tie is moved transversely of its length relative to the collar through such slot. The other end portion of the tie can be engaged in a collar 10 mounted on the winch frame at a location spaced axially from the collar 8 through a slot 11 in the upper side of the collar 10 by movement of the tie stretch transversely of its length through such slot. Such spaced collars are mounted on the winch frame with their bores in axial alignment but with their respective slots 9 and 11 offset circumferentially of the collars as shown best in FIG. 7.

An eye 12 constituting load-connecting means, is secured on one end of the bridging tie by a hollow shank 13 integral with such eye that is swaged on or bonded to one end of the tie. Such eye can be connected to the load L independently of the frame as shown in FIG. 5. Such shank has a stepped portion 14 adjacent to the eye which forms an annular shoulder 15 preferably of a thickness at least as great as the thickness of the collar 8. The outer diameter of the shank 13 is just slightly less than the inner diameter of the collar 8. When the central cable portion of the tie has been moved through the slot 9 into the collar bore, the tie can be moved longitudinally to slide the shank 13 axially into the bore of collar 8 until the shoulder 15 abuts the outer end of such collar. By abutment of the end of collar 8 against shoulder 15 force can be transmitted between the frame and the load, so that such collar and shoulder constitute frame-connecting means.

On the end of the tie 7 remote from eye 12, a second eye 16 is secured, the hollow shank of which is swaged on or bonded to such end portion of the wire rope. In addition, a collar 17 is slidably mounted on the wire rope between the two eyes. The length of the wire rope tie stretch is sufficiently great so that when the shank 13 has been fitted into the collar 8 as described above, the opposite end portion of the tie can be inserted through the slot 11 into the bore of collar 10 by movement of the tie transversely of its length.

The outer diameter of the sleeve 17 is just slightly less than the inner diameter of the collar 10. Consequently, when the portion of the wire rope stretch adjacent to the eye 16 has thus been inserted into the collar 10, the sleeve 17 can be slid from the central portion of the tie toward and into the collar to a position adjacent to eye 16 as shown in FIG. 8. The length of sleeve 17 is greater than the length of the collar 10, and such sleeve has an external annular groove 18 in its end portion adjacent to eye 16. After the sleeve has been inserted fully into the collar, therefore, a retaining spring snap ring 19 can be inserted into the groove 18 of the sleeve 17, as shown in FIG. 8, to retain the sleeve 17 in the collar 10. The eye 16 can be used to connect the tie to an anchor independently of the winch frame 1 by the line 5 as shown in FIG. 5, the eye constituting anchor-connecting means.

Instead of providing an apertured ear 6 to which the anchor tie 5 is connected as shown in FIG. 4, such anchor tie can be connected to the eye 16 of the tie 7. The pull of the winch will react through the collar 8 and shoulder 15 of sleeve 13 and back through the wire rope stretches and eye 16 to the anchor tie 5 in such instance if the winch line 3 is exerting a direct pull on the load. If the winch line is doubled as shown in FIGS. 4 and 5, however, the end of the return stretch of the winch line will be anchored to the eye 12 of the bridging tie 7. In such case one-half of the winch pull will be transmitted directly to the tie 7 from the return stretch of the hauling line connected to the eye 12, and through the tie 7 directly to the anchor tie 5 bypassing the winch frame. The other half of the winch pull will be transmitted to the tie from the winch frame through the collar 8 to the abutment shoulder 15 of the sleeve 13.

With the winch rigged as shown in FIG. 5, the entire reaction force to the winch pull will be transmitted to the end of the tie 7 nearer the load as explained above. The engagement of the collars 8 and 10 carried by the frame 1 with the tie as explained above will prevent the frame from being cocked relative to the anchor tie 5 and bridging tie 7 as shown in FIG. 5.

While hauling line 3 is assumed to extend horizontally in FIG. 5, the winch can be suspended as shown in FIG. 6 to provide a lifting force if desired. In this instance the winch frame 1 is hung by the anchor tie 5' connected to the eye 16 of the bridging tie 7 and the winch line 3 extends down from the drum 2 to constitute a hoisting line.

WINCH DRUM DRIVE TYPE

Referring to FIGS. 9 through 14, the winch is of the manual ratchet type including a ratchet wheel 20 having peripheral teeth 21. The ratchet wheel is driven by a drive pawl 22 engageable with the teeth of the ratchet wheel and preferably having two thrust shoulders to engage two ratchet wheel teeth 21 simultaneously so as to reduce the shear load on the teeth. The ratchet wheel is held against rotation in the direction to pay out the hauling line 3 by a holding pawl 23 pivotally mounted on a shaft 24 and normally pressed resiliently into holding position by a spring 25. Such holding pawl also preferably has two thrust shoulders for simultaneous engagement with two of the ratchet wheel teeth 21 to reduce the shear load on the individual teeth.

Figure 12:
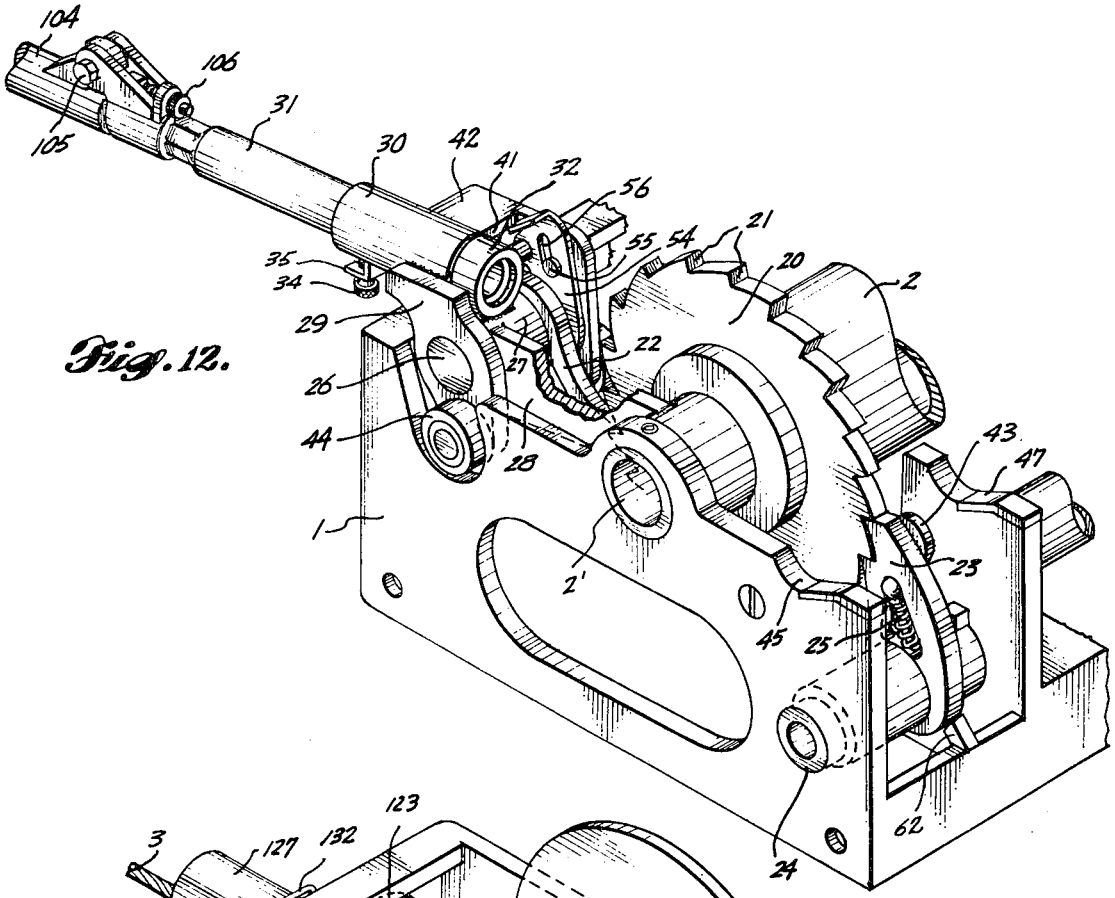
FIGS. 11 and 12 are top perspectives of the winch with parts in the different high-speed haul-in operating positions of FIGS. 9 and 10, respectively, a portion of the winch being broken away in FIG. 12.
Figure 11:
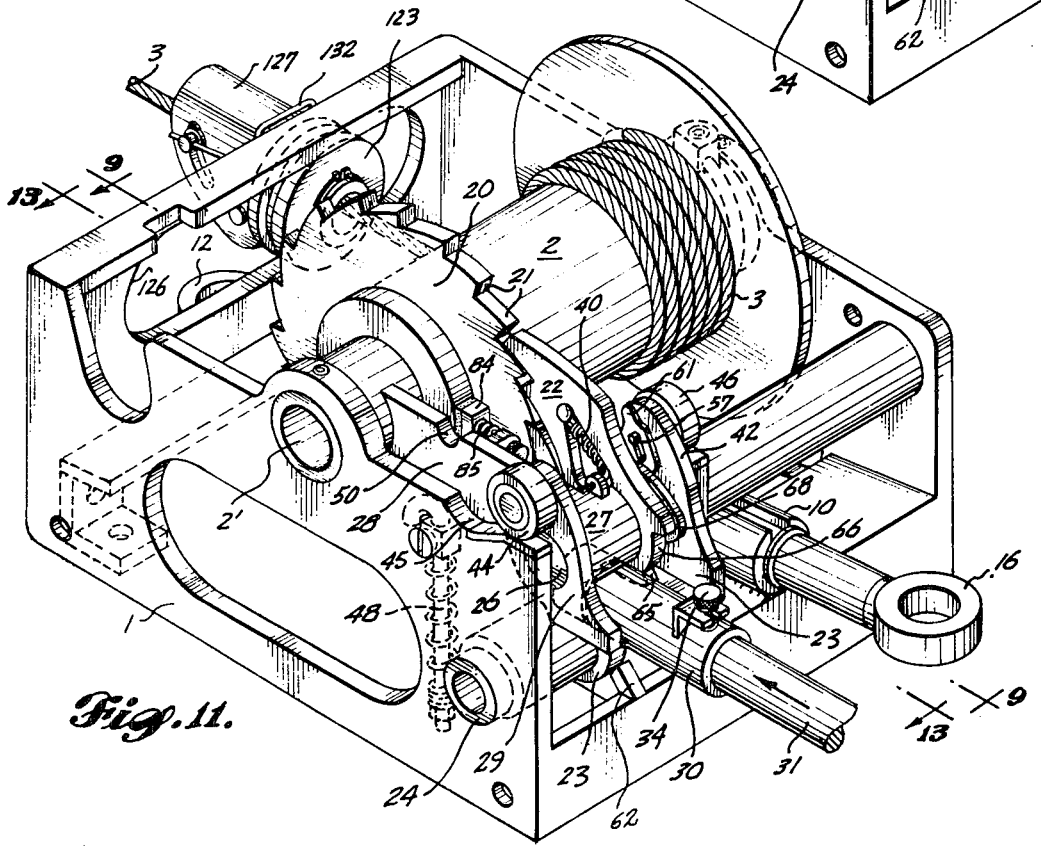

As shown in FIGS. 10, 11 and 12, for example, the shoulders of the teeth 21 of the ratchet wheel 20 are undercut, and the ends of the teeth of the drive pawl 22 and of the holding pawl 23 are inclined so that any pressure between the shoulders of the ratchet wheel teeth and the ends of the drive pawl teeth or holding pawl teeth will produce a force component tending to wedge the driven pawl or the holding pawl into full engagement with ratchet wheel teeth. Also, the teeth of the drive pawl and the teeth of the holding pawl are arranged so that engagement of the tooth closer to the axis of the pawl with a tooth 21 of the ratchet wheel will tend to swing the pawl toward full engagement with the ratchet wheel teeth. In the position of full engagement, both teeth of the drive pawl or of the holding pawl will abut shoulders of adjacent ratchet wheel teeth, as shown in the various figures.

The drive pawl 22 is carried by a shaft 26 mounted in a boss 27 on the swinging end of the cantilever ratchet arm 28. Such ratchet arm swings about the axis of axle 2' independently of rotation of drum 2 and ratchet wheel 20. Shaft 26 also carries a rotatable drive lever 29, on one end of which is fixed a sleeve 30 for receiving one end of a cylindrical bar handle arm 31. Shaft 26 orbits about the axis of axle 2' when ratchet arm 28 is swung by handle 31.

Figure 9:
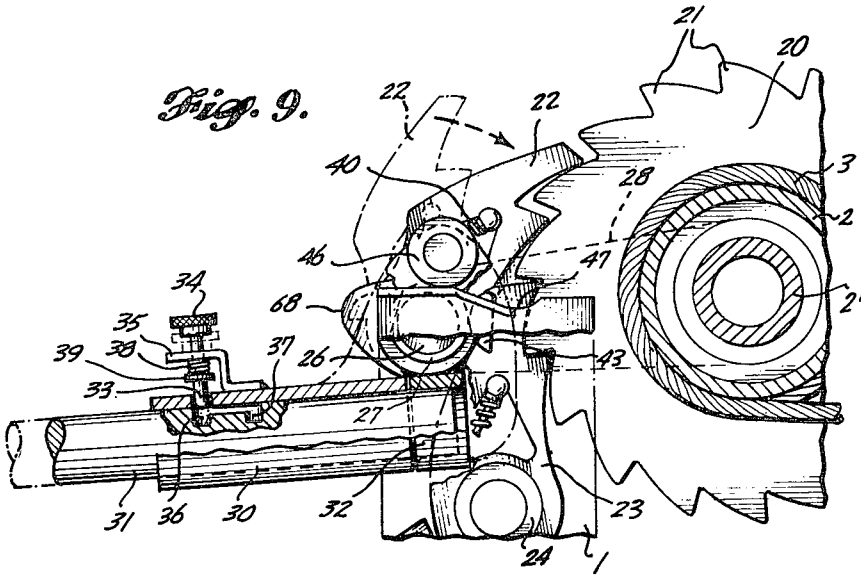

Because the sleeve 30 is mounted on the drive lever 29, it can swing relative to the ratchet arm 28. The shaft 26, the ratchet arm 28 and the portion of drive lever 29 fixed to sleeve 30, constitute a hinge joint connecting the ratchet arm and the handle arm rod 31. A second sleeve 32 is rigidly fixed on the lever boss 27 in a position such that the sleeve 30 can be swung into position in alignment with the sleeve 32 as shown best in FIGS. 9, 10 and 12. The end portion of handle arm rod 31 can be slid lengthwise through sleeve 30 into sleeve 32 when the two sleeves are in alignment as indicated in FIG. 9 to rigidify the hinge joint into a stiff arm condition in which the ratchet arm 28 swings conjointly with the handle arm 31. A latch can hold the rod 31 selectively either in a position bridging between and connecting sleeves 30 and 32 or in a position wholly retracted into sleeve 30. In bridging position the handle rod 31 can swing ratchet arm 28 conjointly with the handle rod to effect high-speed rotation of the ratchet wheel 20, i.e. rotation of such wheel through approximately 180° for each stroke of the handle rod. When the handle rod is retracted out of engagement with sleeve 32, the hinge joint is converted to the pumping arm condition in which each stroke of the handle rod moves ratchet arm 28 an increment sufficient to rotate ratchet wheel 20 through one tooth pitch effecting high-power winch operation, as described in detail below.

As shown best in FIGS. 9 and 10, the handle rod latch includes a pin 33 having a knurled head 34 on its outer end and extending through an aperture in a bracket 35 mounted on one side of the sleeve 30. Two sockets 36 and 37 are provided on one side of the handle rod 31 in axially spaced relationship. Such sockets are blind bores of a size to receive the inner end of the latch pin 33 in holding relationship. Normally the pin 33 is urged into latched position in one or the other of sockets 36 and 37 by a spring 38 engaged between a shoulder on the pin formed by an annular flange 39 and the bracket 35. FIG. 9 shows the latch pin drawn outwardly into unlatched position so that the handle rod 31 can be shifted lengthwise, and FIG. 10 shows the latch pin moved inwardly by spring 38 into the position in which the inner end of such pin is received in socket 36 to hold the handle rod in position bridging between and rigidly connecting the sleeves 30 and 32. A shallow groove connects the sockets 36 and 37 in which the latch pin tip can slide to prevent inadvertent rotation of the handle rod 31 relative to sleeve 30.

HIGH-SPEED HAUL-IN OPERATION

When the winch is used to haul in comparatively light loads, the ratchet wheel 20 carried by the drum 2 can be operated at relatively high speed by the ratchet mechanism. For such operation the handle arm or rod 31 is positioned as shown in FIGS. 9 and 10, so that its end portion is received in both sleeves 30 and 31 and bridges between such sleeves to connect them into a single unit for operating purposes. The handle arm is held in this position by the latch pin 33 being engaged in the socket 36 as shown in FIG. 10.

By positioning the handle arm 31 in the position shown in FIGS. 9 and 10, the sleeve 30 and drive lever 29 carrying it are integrated with the sleeve 32 and ratchet arm 28 into a single unit swingable about the axis of winch drum 2. Swinging of such unit about the winch drum axis will move drive pawl 22 orbitally around such axis. For hauling-in operation of the winch, spring 40, shown best in FIGS. 9, 11, 13 and 14, will urge pawl 22 to swing relative to shaft 26 toward the ratchet wheel 20 so that the thrust shoulders of the pawl will engage teeth 21 of the ratchet wheel.

When the handle arm 31 is swung through approximately 180° from the position of FIGS. 9 and 11 to the position of FIGS. 10 and 12, the thrust shoulders of the drive pawl will engage teeth 21 of the ratchet wheel and rotate such ratchet wheel and the winch drum carrying it conjointly with the swinging handle in the direction indicated by the arrow in FIG. 10 through one-half a revolution. During such turning the holding pawl 23 will be pressed toward the ratchet wheel by its spring 25, so that its thrust shoulders will snap into successive notches of the ratchet wheel as the teeth 21 successively wedge such pawl outward and pass its thrust shoulders. Consequently, if the pressure swinging the handle arm 31 in the clockwise direction as seen in FIGS. 9 and 10 is relieved at any time sufficiently to enable the ratchet wheel 20 to turn in the pay-out direction as much as one tooth pitch, ratchet teeth 21 will engage thrust shoulders of the holding pawl 22 so that such holding pawl will prevent further pay-out rotation of the ratchet wheel 20 and drum 2.

When the handle arm 31 has been swung in the clockwise direction approximately to the position shown in FIG. 10, it can then be swung counterclockwise from that position back approximately to the position of FIG. 9. During such reverse swinging of the handle arm the holding pawl 23 will hold the ratchet wheel 20 against retrograde rotation, and spring 40 will snap the drive pawl 22 successively into the notches between the ratchet teeth 21 as the drive pawl passes such teeth. When the handle arm has reached the position of FIG. 9, its direction of swing can again be changed to clockwise direction so that the drive shoulders of the drive pawl 22 again will abut teeth 21 of the ratchet wheel to turn the ratchet wheel and drum 2 through another half revolution as the handle arm again is swung through approximately 180° from the position of FIG. 9 to the position of FIG. 10.

Manual oscillation of the handle arm 31 can be continued in this manner as long as desired for the purpose of turning the drum 2 through successive increments of approximately a half revolution, in each instance in the haul-in direction. When a hauling operation is completed, pressure can be exerted on the handle arm 31 in the clockwise direction to balance the torque on the winch drum produced by tension of the line 3 wound on the drum, so as to relieve the application of force by teeth 21 of the ratchet wheel 20 against the holding pawl 23.

Figure 13:
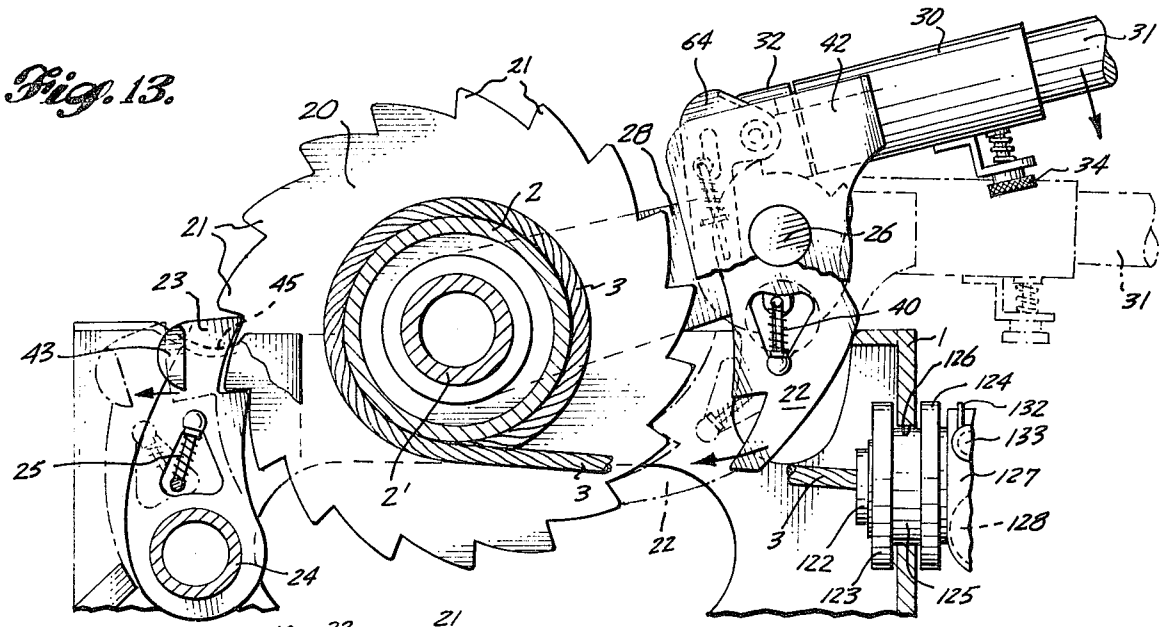
FIGS. 13 and 14 are vertical sections of the winch taken on line 13—13 of FIG. 11, showing parts in high-speed pay-out operating positions, parts being broken away.

Under these conditions the holding pawl 23 can be grasped manually and swung from the solid-line position shown in FIG. 13 to the broken-line position of that figure. By such movement the compression pawl-holding spring 25 will first be further compressed, and as swinging of the pawl is continued, the spring will move past a deadcenter position and press the holding pawl away from the ratchet wheel. If the handle arm 31 is then swung in the counterclockwise direction, tension in the line 3 will cause the ratchet wheel to follow the drive pawl 22 by turning in the direction indicated by the arrow in FIG. 14. If the tension on the line is relieved by turning of the winch drum 2 through one-half a revolution or less, the line 3 can be detached from the load to complete the hauling operation.

HIGH-SPEED PAY-OUT OPERATION

In some instances it may be desirable to lower a load under power instead of simply detaching the hauling line 3 from the load. The winch can be operated to pay out line 3 under load in the manner indicated in FIGS. 13 and 14. The handle arm 31 is swung manually to the solid-line position shown in FIG. 13 with the drive pawl 22 swung away from the ratchet wheel 20 and held in that position by the spring 40. As the handle arm is swung farther in the direction indicated by the arrow in FIG. 13 toward the broken-line position, the curved outer edge of the drive pawl will engage the frame 1 as shown in FIG. 13, and such engagement will wedge the drive pawl toward the broken-line position until spring 40 passes a dead center position so that it will exert a force to swing the pawl toward the ratchet wheel 20, as indicated in broken lines.

Figure 14:
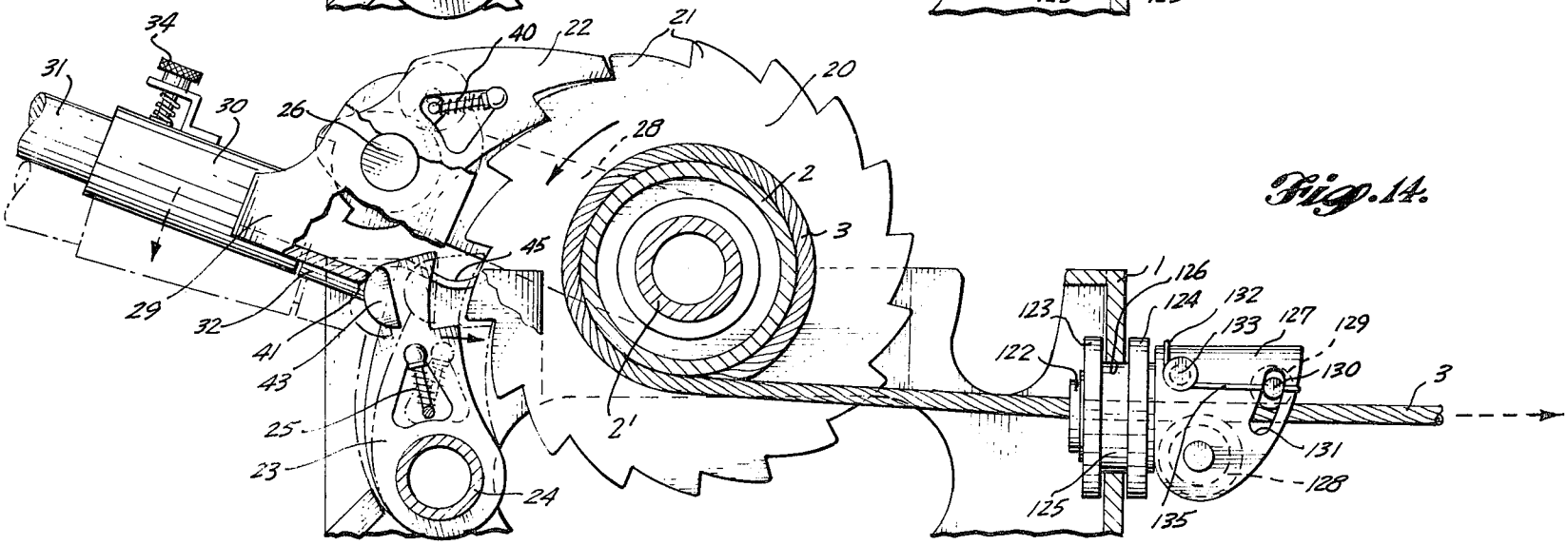

When the drive pawl has thus been engaged with the ratchet wheel, the handle arm is swung farther in a clockwise direction an amount sufficient to relieve all pressure of ratchet teeth 21 on the holding pawl 23. The holding pawl can then be swung manually from the solid-line position of FIG. 13 into the broken-line position, in which position it will be held by compression spring 25. The manual force exerted on the handle arm 31 is then relieved to the extent necessary to enable the handle arm to swing in the counterclockwise direction as seen in FIGS. 13 and 14, through approximately one-half a revolution, to the position of FIG. 14. During such movement the winch drum 2 will be turned in the pay-out direction to approximately one-half a revolution.

As the handle arm 31 approaches the end of a pay-out stroke, as indicated in FIG. 14, a shoulder 41 of the angle lever 42 integral with and supporting the side of sleeve 30 opposite lever 29 will engage a cam lug 43 mounted on the swinging end of holding pawl 23 and wedge such lug and holding pawl from the solid-line position of FIG. 14 in a clockwise direction, as indicated by the arrow, until the spring 25 passes dead center to complete swinging of the holding pawl into engagement with the ratchet wheel 20. Further movement of the handle arm 31 from the solid-line position of FIG. 14 toward the broken line position will enable abutment surfaces of ratchet teeth 21 to engage thrust shoulders of the holding pawl 23 to prevent further rotation of the ratchet wheel and winch drum in the pay-out direction.

With the ratchet wheel 20 thus held by the holding pawl 23, the handle arm may be moved slightly farther in the counterclockwise direction sufficiently to free the drive pawl 22 from the teeth 21 of the ratchet wheel 20. The drive pawl can then be grasped manually and again swung from the solid-line position of FIG. 14 to the broken-line position of FIG. 9, in which it will be held by the spring 40 so that the handle arm 31 can be swung freely in a clockwise direction into the solid-line position shown in FIG. 13. Further swinging of the handle arm in the clockwise direction toward the broken-line position of FIG. 13 will then cause the drive pawl 22 to be wedged into position for engagement with ratchet wheel teeth 21 as previously described, for transferring the load to it and relieving the holding pawl 23 so that it can be withdrawn again to the broken-line position of FIG. 13, for enabling the handle arm, ratchet wheel and drum to be turned through the next half revolution increment in the pay-out direction.

HIGH-POWER HAUL-IN OPERATION

In the operation described above the winch drum 2 and ratchet wheel 20 have turned through the same angular movement as the angle of swing of the handle arm 31, so that the mechanical advantage provided by the winch has been the ratio between the length of the handle arm 31 from the axis of the winch drum to the operator's hand and the radius of the winch drum, which might, for example, be eight to one or ten to one. The mechanism of the winch is convertible readily to provide high-power operation affording a much greater mechanical advantage, such as in the range between 30 and 40 to 1 where the ratchet wheel has 18 teeth as shown. By lengthening the handle arm, increasing the working angle of handle arm swing, increasing the size of the ratchet wheel, reducing the pitch of the ratchet teeth and reducing the length of the levers which operate in the high-power conversion, the mechanical advantage can be increased to over 300 to 1.

In order to increase the mechanical advantage between the movement of the hand operating the handle arm 31 and the movement of the winch drum, operation of the winch can be altered so that, when the handle is swung, the winch drum 2 is turned through approximately 20°, corresponding to each of the eighteen ratchet wheel teeth 21, instead of being turned through approximately 180°. Thus the rotation of the winch drum will be indexed only one tooth pitch for each swing of the handle. In order to accomplish this operation of the winch, the head 34 of latch pin 33 is pulled outward from the position of FIG. 10 to the position of FIG. 9 so as to release the inner end of the pin from the socket 36 in the handle arm 31. The handle arm can then be shifted lengthwise outward until socket 37 is aligned with latch pin 33. By such lengthwise movement of the handle arm 31 its inner end is withdrawn from sleeve 32 so that the handle rod no longer connects the two sleeves 30 and 32 for conjoint movement. If the head 34 of the latch pin is then released, the spring 38 will press such latch pin inward to seat the inner end of the latch pin in the socket 37 to hold the handle arm in its outer position.

As has been described previously, sleeve 30 is secured to and carried by one end of lever 29, which in turn is mounted on shaft 26. The companion angle lever 42 attached to the opposite side of sleeve 30 is also carried by shaft 26, so that the two levers 29 and 42 are swung conjointly relative to the ratchet arm 28 by swinging of handle arm 31 relative to the ratchet arm when the sleeves 30 and 32 are not interconnected by the handle arm 31.

Each of the drive levers 29 and 42 has a portion projecting to the side of shaft 26 opposite the portion attached to sleeve 30. Such oppositely projecting portion of lever 29 carries a cam roller 44 engageable with a cam track 45 on the winch frame 1. The oppositely projecting portion of angle lever 42 carries a cam roller 46 rotatable about the same axis as roller 44 and engageable with a cam track 47 on the winch frame 1, as shown best in FIG. 12. The two cam tracks are the same shape so that the two levers are guided by their respective cam tracks to move correspondingly.

Figure 18:
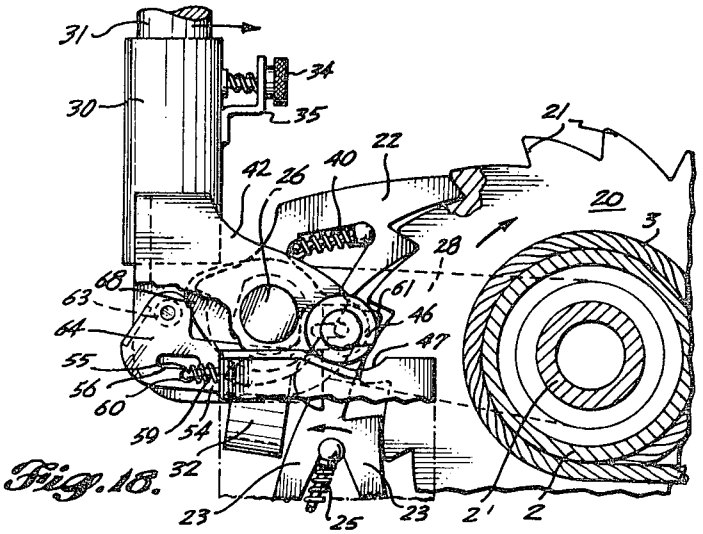
Figure 20:
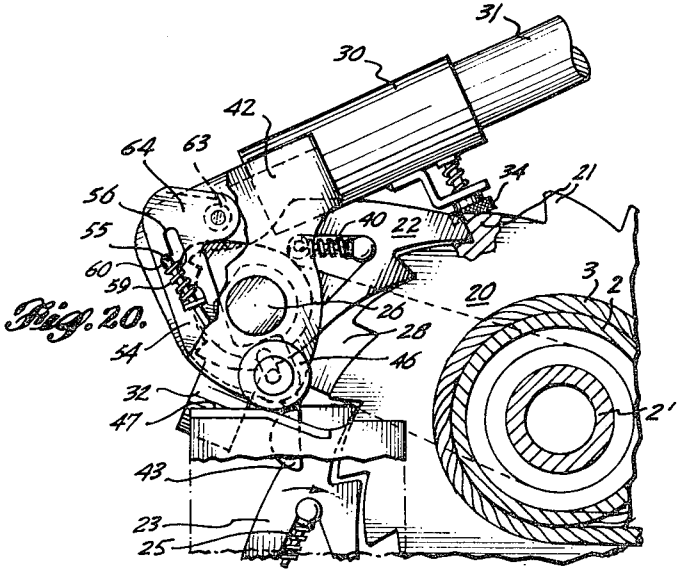
Figure 17:
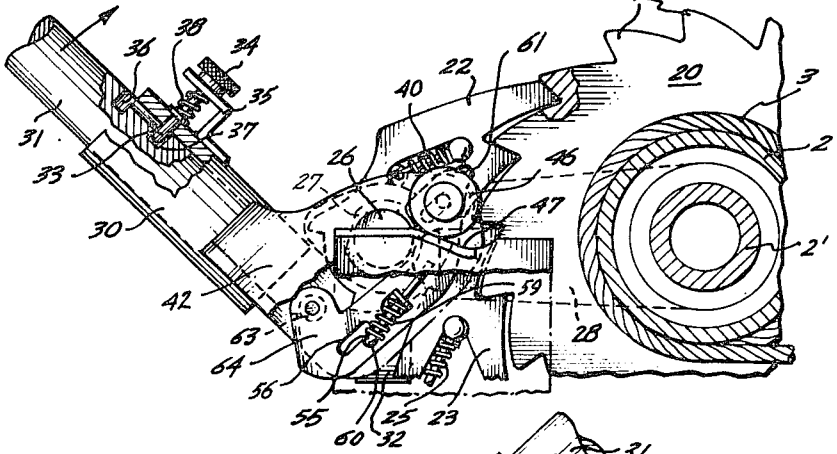
Figure 19:
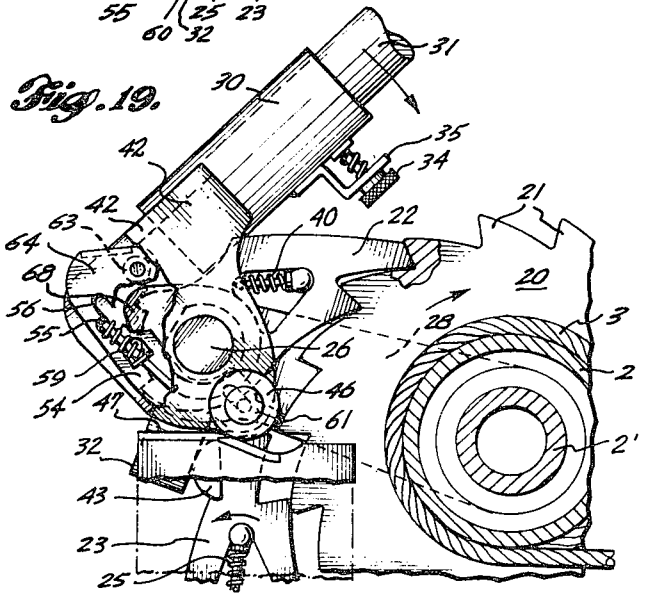

The cam tracks 45 and 47 are shaped so that as the handle arm 31 and levers 29 and 42 are swung conjointly relative to the ratchet arm 28 from the positions shown in FIG. 17 through the positions of FIGS. 18 and 19 to the positions of FIG. 20, requiring the handle arm to be swung through an angle of at least approximately 90° relative to the ratchet arm 28, such ratchet arm will be wedged in the clockwise direction, as seen in FIGS. 17, 18, 19 and 20, through an angle sufficient to rotate the ratchet arm and the winch drum 2 through an angle corresponding to one tooth pitch. Such swinging of the ratchet arm is accomplished by swinging of the handle arm 31 conjointly with levers 29 and 42 to move cam rollers 44 and 46 in wedging engagement with their respective tracks 45 and 47.

The principal swinging of the ratchet arm is accomplished during swinging of arm 31 between the position of FIG. 18 and the position of FIG. 20 through an angle of approximately 60°, during which a line joining the axis of lever shaft 26 and the axis of the cam wheels 44,46 turns from a position generally parallel to the cam tracks 45 and 47 into a position nearly perpendicular to such cam tracks at the point of contact of the cam wheels, such as at an angle between 80° and 90° relative to the cam tracks. Moreover, the cam tracks slope downward so that for each equal increment of swing of the handle arm, the ratchet arm will also move through substantially equal angular increments, but different from the handle arm angles. Consequently, the effort required to swing the handle arm will be substantially constant for all positions of swing of the handle arm. The slope away from the pivot axis of the levers 29 and 42 of the two end portions of the tracks can also be increased to decrease the effort required to swing the handle arm at the beginning and the end of the hauling-in portion of the stroke.

At the beginning of a high-power stroke of handle arm 31, as shown in FIG. 17, the ratchet wheel 20 will be held against pay-out rotation by the holding pawl 23. As the handle arm is swung to the position of FIG. 18, the thrust shoulders of the drive pawl 22 will be pressed against teeth 21 of the ratchet wheel, and continued swinging of the handle in the direction indicated through the position of FIG. 19 to the position of FIG. 20, will effect rotation of the ratchet wheel 20 in the hauling-in direction indicated by the arrows through a distance equal to approximately the pitch angle between adjacent ratchet teeth 21.

By such rotation of the ratchet wheel 20 the teeth 21 engaged with the thrust shoulders of the holding pawl 23, as seen in FIG. 17, will be moved away from such thrust shoulders progressively as shown in FIGS. 18 and 19 until successive teeth pass beyond such shoulders. The spring 25 will then snap the holding pawl from the position of FIG. 19 to the position of FIG. 20, so that it will again be in position for abutment with ratchet teeth.

As soon as the holding pawl 23 snaps into the position of FIG. 20, swinging of the handle arm 31 in a clockwise direction can be interrupted and the handle swung in the counterclockwise direction. Such swinging will allow the ratchet wheel 20 to move slightly in the pay-out direction until the shoulders of teeth 20 abut the thrust shoulders of the holding pawl 23. Counterclockwise swinging of the handle arm from the position of FIGS. 16 and 20 to the position of FIGS. 15 and 17 will cause the cam wheels 44,46 to roll down the cam tracks 45 and 47 enabling the ratchet arm 28 supported by levers 29 and 42 to swing relative to ratchet wheel 20 held by pawl 23 from the position of FIG. 20 through the positions of FIGS. 19 and 18, back to the position of FIG. 17 ready for the next haul-in stroke of handle arm 31.

During such counterclockwise swinging of the ratchet arm 28, the pawl 22 will be wedged outward by the ratchet teeth 21 so that, at the time the handle arm has reached the position of FIG. 17, the drive pawl will again have been snapped into a position in which its thrust shoulders are engaged with abutment surfaces of a new, trailing pair of teeth 21 by pressure of spring 40. The direction of swing of handle arm 31 can then again be reversed to the clockwise direction as indicated by the arrows in FIGS. 17, 18 and 19, so that the drive pawl 22 will index the ratchet wheel 20 through another increment equal to a pitch between teeth 21. By repeating this procedure, the winch drum 2 will be turned in the haul-in direction, step-by-step, in increments equal to the pitch of ratchet teeth 21.

In order to hold the winch drum 2 more positively in a selected position, the handle arm 31 can be swung counterclockwise from the solid-line position of FIG. 20. Such swinging of the handle will roll the cam rollers 44 and 46 over the crowns in their respective cam tracks 45 and 47 so that any force of the teeth 21 of ratchet wheel 20 against drive pawl 22 will simply tend to press handle arm 31 farther downward toward the winch frame instead of tending to swing the handle arm in a pay-out direction.

Figure 15:
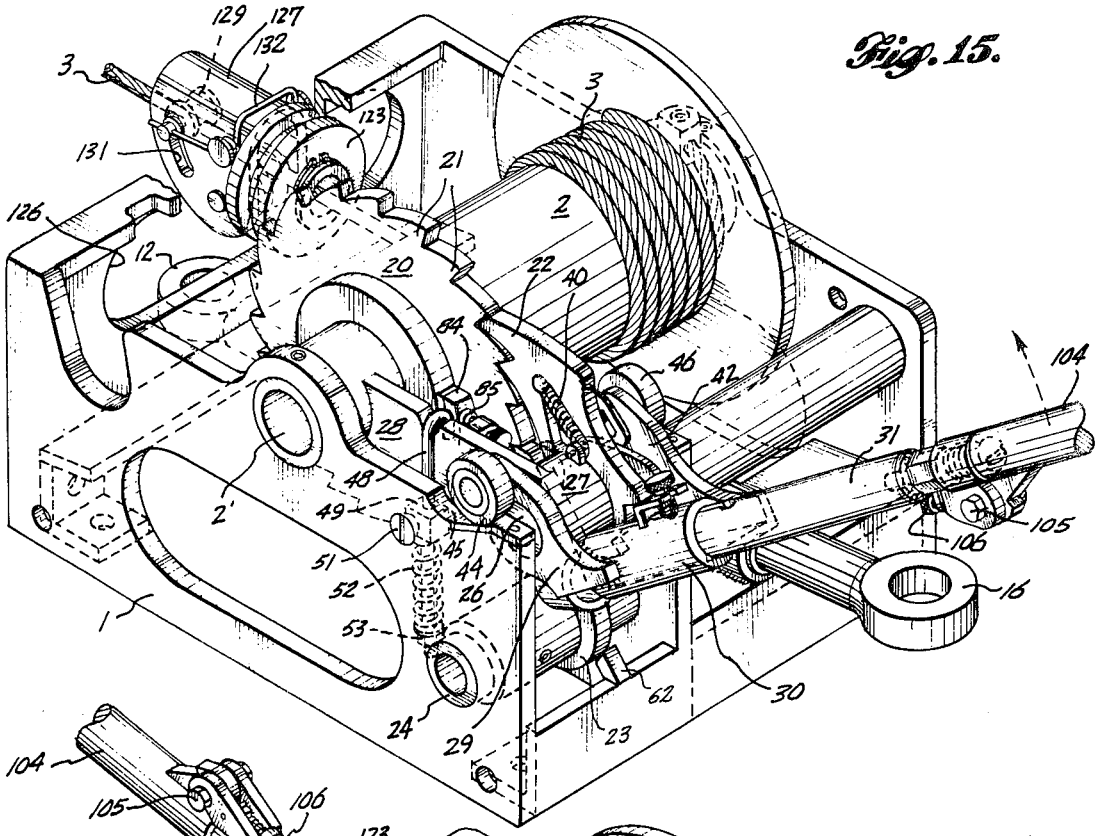
FIGS. 15 and 16 are top perspectives corresponding generally to FIG. 11, but showing parts in high-power haul-in operating positions.
Figure 16:
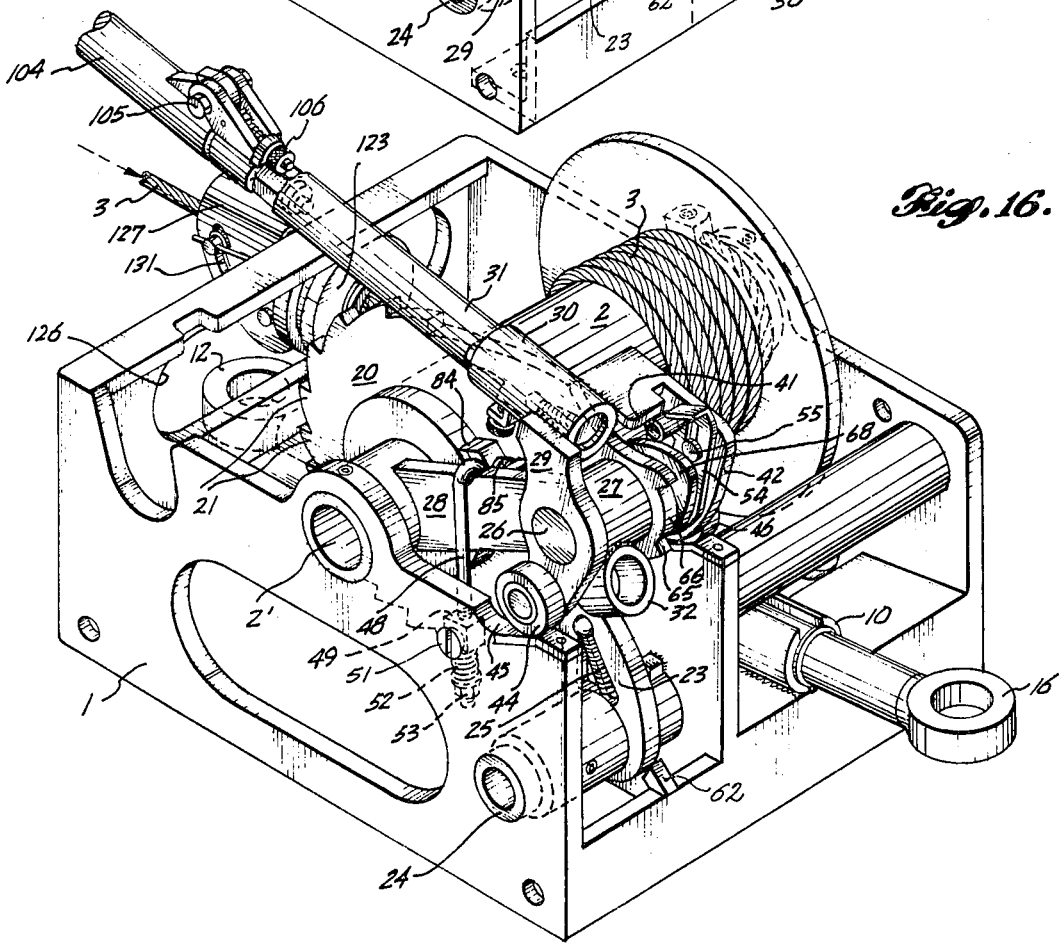

In order to maintain the ratchet arm 28 in a position to insure that the cam rollers 44 and 46 will be retained in engagement with the cam tracks 45 and 47, respectively, a hook 48 (FIGS. 15 and 16) carried by a block 49 can be engaged with a notch 50 in the edge of ratchet arm 28, which is the upper edge when the arm is in the general position of FIGS. 11, 15 and 16. Block 49 is pivotally mounted on the frame 1 by a pivot bolt 51, as shown in FIGS. 11, 15 and 16. A compression spring 52 encircles the shank of the hook between block 49 and a stop shoulder 53 on the lower end of the hook shank, which can be formed by a nut and a washer. Such spring urges the hook shank to slide downward through the aperture in its mounting block 49.

During high-speed operation of the winch illustrated in FIGS. 9 to 14, when the ratchet arm 28 is swung through approximately one-half a revolution during each stroke, the hook 48 will be disengaged from the ratchet arm and will occupy a position alongside a frame wall as indicated in broken lines in FIG. 11. When it is desired to effect high-power operation of the winch, the hook can be raised from the position of FIG. 11 and swiveled through an angle of 90° for engagement with the notch 50 in the edge of ratchet arm 28. The hook will then be raised from the position of FIG. 15 to that of FIG. 16 each time the ratchet wheel 20 is indexed in the haul-in direction by swinging of the handle arm from the position of FIG. 17 to the position of FIG. 20 as described above.

In order to convert the winch from the high-speed operating condition to the high-power operating condition, therefore, it is desirable both to shift the handle arm 31 from the condition of FIG. 10 outward to the condition of FIG. 17 and also to move the hook 48 upward from the broken-line position shown in FIG. 11 to the position engaged with ratchet arm 28 as shown in FIG. 16. The winch can then be operated in the high-power type of operation described above by pumping the handle arm 31 back and forth as rapidly as may be desired without risk of the cam rollers 44 and 46 being disengaged from their frame tracks 45 and 47. When it is desired to convert the winch back to the condition for high-speed operation, the handle arm 31 will be shifted lengthwise toward sleeve 32 again from the position of FIG. 17 to the position of FIG. 10, and the hook 48 will be disengaged from the ratchet arm 28 and lowered back to the stored position shown in broken lines in FIG. 11.

HIGH-POWER PAY-OUT OPERATION

In some instances it may be desired to lower a heavy load by turning the winch drum 2 in a direction to pay out line 3 while it is under tension. The winch can be converted readily for such operation by the manipulation illustrated in FIGS. 21, 22 and 23, after which pay-out can be effected by pumping the handle arm 31 in the manner indicated in FIGS. 24 to 29. A pawl-control slide 54 is located alongside the angle lever 42 and is retained by a first headed pin 55 carried by lever 42 and extending through a slot 56 and a second headed pin 57 carried by lever 42 and extending through a slot 58. The slide 54 is elongated, and the slots 56 and 58 are located adjacent to opposite ends of the slide and are disposed with their lengths in parallel relationship.

A compression spring 59, shown best in FIGS. 22, 24 and 25, engaged between the slide 54 and pin 55 urges the slide in one direction. The slide can be moved in opposition to spring 59 fully in the opposite direction and held in such extreme position by tilting the slide relative to lever 42 to engage the keeper notch branch 60 of slot 56 with pin 55, as shown in FIGS. 19 and 20. The slide is latched in such inoperative position during high-speed haul-in and pay-out operations and during high-power haul-in operation. For high-power pay-out operation the slide is tilted relative to lever 42, to release the keeper notch 60 of slot 56 from pin 55, as indicated in FIG. 21, so that the slide can move relative to such lever lengthwise of slots 56 and 58, as indicated in FIGS. 22 and 23. When the slide is so released, it will operate to retract holding pawl 23 from engagement with teeth 21 of ratchet wheel 20.

The tip of slide 54 near holding pawl 23 forms a finger 61 engageable with lug 43 carried by the holding pawl. After the slide 54 has been swung to release keeper notch 60 from pin 55 as indicated in FIG. 21, spring 59 will promptly shift slide 54 into the position shown in FIG. 22. If handle arm 31 is then swung in the counterclockwise direction from the position shown in FIGS. 21 and 22 to the position of FIG. 23, the finger 61 will engage the lug 43 to press slide 54 in the direction indicated by the arrow in FIG. 23 in opposition to the force of spring 59. Such yielding movement of slide 54 will enable finger 61 to pass from the left side of lug 43, as shown in FIG. 23, to the right side of that lug, as shown in FIG. 24, as handle arm 31 is swung farther.

When the tip of slide 54 has passed lug 43 of holding pawl 23, spring 59 will slide lever 54 inward again so that finger 61 projects into overlapping relationship with lug 43 to the position shown in FIG. 24. If handle arm 31 is then swung in the clockwise direction from the position of FIG. 24 to that of FIG. 25, the finger 61 will engage the right side of lug 43 to kick the holding pawl 23 from the operative position of FIG. 24 into the inoperative positive of FIG. 25, whereby the pawl is out of engagement with ratchet wheel teeth 21. During such release of pawl 23, the ratchet wheel 20 will be held against movement in the pay-out direction by drive pawl 22.

The winch mechanism has thus been converted to high-power pay-out condition so that line can be paid out under heavy load by the sequence of operations represented by FIGS. 24 to 29, inclusive. With the load on line 3 urging the winch drum 2 and ratchet wheel 20 to rotate in the counterclockwise direction, as shown by the arrows in FIGS. 24 and 25, handle arm 31 can be swung in the counterclockwise direction from the position of FIG. 25 through the position of FIG. 26 to the position of FIG. 27. During such movement of the handle arm, holding pawl 23 will be held in the broken-line fully-released position of FIG. 25 by spring 25. Swinging of pawl 23 in the releasing direction about the axis of its supporting shaft 24 will be limited by engagement of the pawl with the stop 62.

Figures 26, 27, 28, 29:
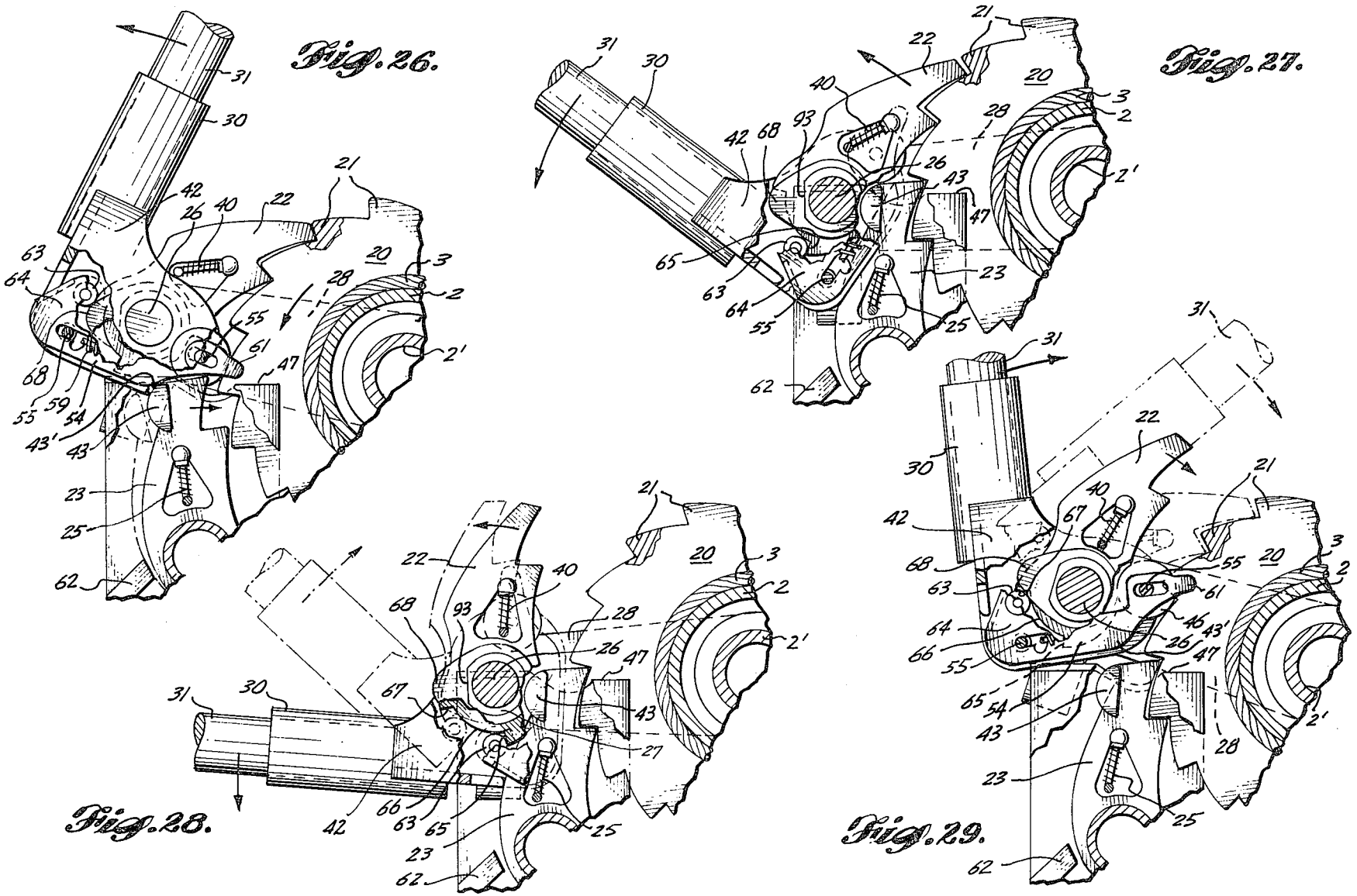
Figure 40:
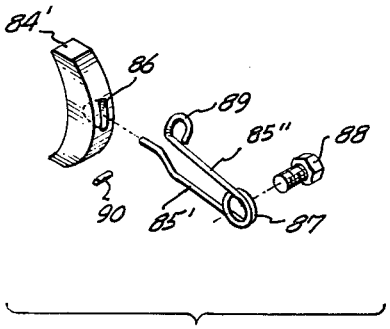
FIG. 40 is a top perspective of parts of the winch mechansim shown in FIGS. 37, 38 and 39, arranged in exploded relationship.
Figure 39:
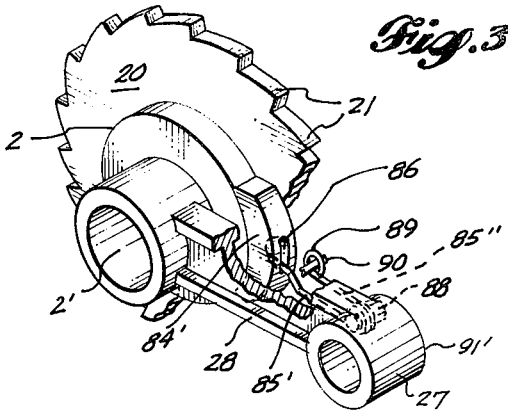
FIG. 39 is a top perspective of part of the winch mechanism shown in FIGS. 37 and 38, having parts broken away.

As the handle arm is swung in the counterclockwise direction from the position of FIG. 25 to the position of FIG. 26, rotation of ratchet wheel 20 will be eased in the counterclockwise direction as indicated by the arrow in FIG. 26 being held by the drive pawl 22. As the handle arm 31 is swung counterclockwise as indicated by the arrow from the position just prior to that shown in FIG. 26 toward the position of FIG. 27, edge 43' of slide 54 will engage the lug 43 of holding pawl 23 and swing such pawl from the released position toward ratchet wheel 20 in opposition to the force of spring 25. When the holding pawl has been swung in this manner through an angle sufficient to enable spring 25 to pass over dead center, the spring will continue to swing the holding pawl in the clockwise direction as seen in FIGS. 26 and 27, until its thrust shoulders are again in position for abutment by teeth 21.

When teeth 21 come into abutment with the thrust shoulders of the holding pawl 23, as shown in FIG. 27, further swinging of handle arm 31 in the counterclockwise direction from the position of FIG. 27 to the position of FIG. 28 will effect swinging of drive pawl 22 relative to ratchet arm 28 in the direction of the arrow from the operative position shown in FIG. 27 to the inoperative or released position shown in FIG. 28. Such movement of the drive pawl is accomplished by roller 63, carried by a hooked portion 64 on the end of slide 54 remote from finger 61. As the handle arm 31 is swung, such roller engages a shoulder 65 constituting one end of a wide circumferential cutout forming a track 66 in the root portion of pawl 22, as shown in FIG. 28. Also, when the ratchet arm 28 has been moved to this position its boss 27 will be lodged behind the holding pawl 23, as shown in FIGS. 9, 11, 17 and 28, for positively blocking the swinging of the holding pawl 23 out of engagement with teeth 21 of the ratchet wheel 20.

When engagement of roller 63 with notch shoulder 65 has swung drive pawl 22 sufficiently far from the ratchet wheel 20 to enable spring 40 to pass dead center position, the force produced by such spring will be reversed to urge the drive pawl in the counterclockwise direction indicated by the arrow in FIG. 28. Swinging of the handle arm 31 can then be reversed. As the handle arm is moved from the solid-line position of FIG. 28 to the broken-line position of that figure and the drive pawl is swung by spring 40 into the broken-line position, the wheel 63 moves along the notch 66 almost to its opposite end. As handle 31 is swung further to the solid-line position of FIG. 29, drive pawl 22 will be shifted clockwise while being held out of contact with the ratchet wheel. When swinging of the handle in the clockwise direction is continued from the solid-line position of FIG. 29 to the broken-line position of that figure, the wheel 63 bears on the shoulder 67 of track 66 to swing drive pawl 22 in the clockwise direction in opposition to the force of spring 40.

When spring 40 of drive pawl 22 passes the dead center position, the force of such spring will continue to swing the pawl into the broken-line position of FIG. 29 engaged with the ratchet wheel 20. In order to enable handle arm 31 to continue to be moved easily in the counterclockwise direction, wheel 63 is shifted out of track 66 by engagement with the lobe of a cam 68 fixed on ratchet arm 28. Such engagement of wheel 63 with the cam lobe will move slide 54 to the left, as seen in FIG. 29, in opposition to the force of spring 59.

As the handle arm 31 continues to be swung in the clockwise direction from the broken-line position of FIG. 29, as indicated by the broken-line arrow in that figure, the thrust shoulders of drive pawl 22 will press against teeth 21 so as to transfer the load of the ratchet wheel 20 from the holding pawl 23 to the drive pawl. Continued clockwise swinging of the handle arm 31 from the position of FIG. 24 toward the position of FIG. 25 will cause the finger 61 of slide 54 to engage lug 43 of holding pawl 23 and kick it into the inoperative or release position of FIG. 25 in the manner previously described. The finger 61 of slide 54 is in a position to accomplish this operation because as roller 63 passes over the lobe of cam 68 between the positions of FIGS. 29 and 24, the spring 59 will again shift the slide inward to position finger 61 as indicated by the arrow in FIG. 24.

If, after being swung clockwise to the position of FIG. 25, the handle arm 31 again is swung in the counterclockwise direction, the ratchet wheel 20 will be eased in the pay-out direction through another increment of counterclockwise turning equal to the pitch of the ratchet teeth. The lever may then continue to be pumped for paying out line 3 under heavy load, while the winch mechanism follows the sequence illustrated by FIGS. 26, 27, 28, 29, 24 and 25.

REFINEMENTS

FIGS. 30 to 36 show certain components of the winch described above in somewhat modified form, and FIGS. 32 and 36 show more details of the construction because the parts are in exploded relationship. Such components constitute alternatives to the corresponding components of the winch described above.

FIGS. 30 and 33 to 36 show a modified type of resilient movement-limiting or control mechanism for the ratchet arm 28 employed during high-power operation of the winch. This mechanism constitutes a substitute for the hook 48 shown in operation in FIGS. 15 and 16. The alternative control mechanism includes a bifurcated spring wire member having a longer bifurcation 69, one end of which is connected to a spring torsion coil 70 joining the bifurcations and encircling a mounting hub 71 bolted to the inner side of the winch frame 1 at the side of the drum axis remote from the cam track 45. Such wire member has a substantially semicircular portion 72 forming the end of the longer bifurcation or leg 69 of the spring member. Such semicircular wire end portion constitutes a handle that can be grasped to engage such end portion with a headed pin 73 carried by and projecting from a side of the ratchet arm 28 as shown in FIGS. 30, 34 and 35.

The longer leg or bifurcation 69 of the wire member is guided for movement transversely of its length by being received between a confining wire 74 and the winch frame. The resilient wire member can apply a downward force to the pin 73 when its end 72 is engaged with such pin, because the shorter bifurcation or leg 75 of the member is prevented from swinging relative to the frame by being engaged beneath a pin 76, as shown in FIGS. 33, 34 and 35. In order to relieve the ratchet arm 28 from the resilient force of the wire member bifurcation 69, the semicircular end portion 72 of the wire can be grasped and the bent portion of the wire carrying such end portion can be tilted away from coil 70 to release the semicircular end portion of the wire from engagement with pin 73. The bent end 72 can then be lowered past pin 73 and released. The resilience of the wire will then move the bent end portion down to the disengaged position shown in broken lines in FIG. 34 and in solid lines in FIG. 33, in which it will remain while the winch is being operated in its high-speed condition.

Another modification shown in FIGS. 30, 31 and 32 can be substituted for the latch mechanism including pin 33 (FIGS. 9 and 10) to hold the handle rod 31 either in the high-speed position of FIG. 10 or in the high-power position of FIG. 17. The alternative latch is also in the form of a bifurcated resilient wire having a long leg 77 projecting from one side of a spring loop 78 and a short leg 79 projecting from the other side of such loop. The loop is secured in the threaded bore 80′ in angle lever 42 by a bolt 80 extending through such loop; this assembly is shown in FIG. 30. The short leg 79 of the spring member is bent upward to hook around the edge 41 of the angle lever as shown in FIG. 30.

The longer leg or bifurcation 77 of the latch wire extends from the coil 78 alongside the sleeve 30 generally parallel to it, as shown in FIGS. 30 and 31. The end of such bifurcation has a bend 34′ serving as a handle for moving the bifurcation 77 away from the sleeve 30. Between the handle bend 34′ and the linear portion of the leg 77 the latch wire includes a sharp reverse-bent portion 33′ that can extend inward through an aperture 30′ in the sleeve 30 for engagement selectively in sockets 36 and 37 of the handle rod 31, as shown in FIGS. 9, 10 and 17, for holding such handle rod either in the position of FIG. 10 or in the position of FIG. 17.

Another alternative construction shown in FIGS. 30, 31 and 32 is a substitute for the pawl-actuating slide 54 shown and described principally in connection with FIGS. 17 and 21 to 29. The alternative pawl-actuating slide is made principally of wire, including a slide portion 54′. In this device the slot and pin elements are interchanged. The wire extends through an aperture in a stem 63′. The nonrotative stem or axle 63′ has a pin or roller 55′ on one end and a roller 63 journaled on its opposite end. The guide pin or roller 55′ can slide in a slot 56′ in the angle lever 42. Such slot will guide lengthwise movement of the wire 54′ through a guide aperture 57″ in a head 58′ that is carried by a shank 57′ insertible into an axial aperture 46′ in cam roller 46.

The end portion 61′ of the wire 54′ extends beyond head 58′ and constitutes a finger engageable with lug 43 of holding pawl 23 to swing such pawl during high-power operation of the winch as described in connection with FIGS. 24 and 25. The wire slide 54′ will normally be urged in the direction to project finger 61′ by a wishbone spring 59', 82 having a loop that is secured by a cap screw 81 screwed into threaded aperture 81' in angle 42, as shown best in FIG. 30. One bifurcation 82 of such spring engages the angle bracket 42 while the other bifurcation 59' of the spring is engaged in a hole in the flattened end 83 of the slide wire 54'.

The slide mechanism is assembled by inserting end 61' of slide 54' through the aperture of stem 63', pulling the wire through such aperture, sliding bifurcation 59' of the wishbone spring through the aperture in flattened end 83 of the slide and inserting pin or roller 55' into the open end slot 56', 60' of lever 42. Thereafter, slide end 61'will be slid through aperture 57'' of head 58', shank 57' inserted through aperture 42' of lever 42, aperture 46 of roller 46 pressed onto such shank and the boss of such roller pressed into aperture 42'. Aperture 57'' is large enough to permit the finger portion 61' to slide relative to head 58' for retraction and extension of such finger.

During high-power operation of the winch, the roller 63' will engage shoulders 65 and 67 of the drive pawl track 66, as previously explained in connection with roller 63, and engage cam 68 to retract slide 54'. During high-speed operation of the winch, the wire slide 54' is held in a position with finger 61' retracted to the position shown in FIG. 31 by the pin or roller 55' being engaged in the notch 60' communicating with slot 56', as shown in FIGS. 31 and 32.

WINCH DRUM BRAKE MECHANISM

In rigging the winch it will usually be desirable to pay out line without the necessity of moving the handle arm 31. For such operation both the drive pawl 22 and the holding pawl 23 must be disengaged manually from the teeth 21 of the ratchet wheel 20. In addition, it is preferred that the handle arm 31 be in the position interconnecting the sleeves 30 and 32, as shown in FIGS. 13 and 14, so that the position of the ratchet arm 28 can be controlled positively. The handle arm should be in the position of FIG. 14, in which the shoulder 41 of the angle bracket 42 is simply resting on the lug 43 without sufficient force being exerted on the handle arm to swing it downward and wedge the holding pawl 23 into engagement with the ratchet wheel in opposition to the force of spring 25. The drive pawl 22 will be swung manually approximately to the position shown in broken lines in FIG. 9, in which position it will be maintained by spring 40.

When both the drive pawl 22 and the holding pawl 23 are disengaged from the teeth 21 of the ratchet wheel 20, it is ordinarily preferred that the winch drum 2 not be completely free to rotate. As shown in FIGS. 11 and 15, a friction brake 84 carried by the ratchet arm 28 may be provided, which is pressed by a compression spring 85 against the portion of the winch drum adjacent the ratchet wheel 20. Spring 85 can be selected or adjusted to provide the desired degree of friction so that it will be necessary to exert a positive pull of some degree on the line 3 in order to turn the winch drum in the pay-out direction. The retarding force exerted by the brake shoe 84 on the drum is not sufficient to increase appreciably the manual effort that must be exerted on the handle arm 31 to operate the winch either in the haul-in or pay-out direction.

Actually no retarding force on the drum is necessary for deterring rotation of the winch drum in the haul-in direction. A modified type of brake is shown in FIGS. 30 and 37 to 40, which will exert virtually no retarding force on the winch drum except when the drum is turned in the pay-out direction. This brake includes a brake shoe 84' engageable with the periphery of drum 2 and having a socket 86 in its central portion to receive an end of one bifurcation 85' of a hairpin type of spring. Such spring includes an eye 87 from which the bifurcations extend, which can be secured to the ratchet arm 28 by a cap screw 88.

Figure 38:
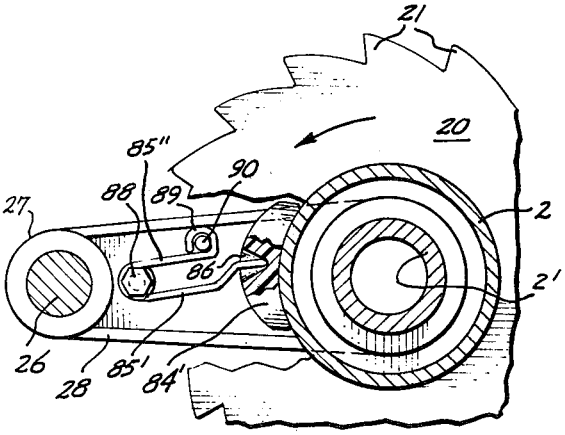
FIG. 38 is a similar view with parts in different positions, parts being broken away in both instances.
Figure 37:
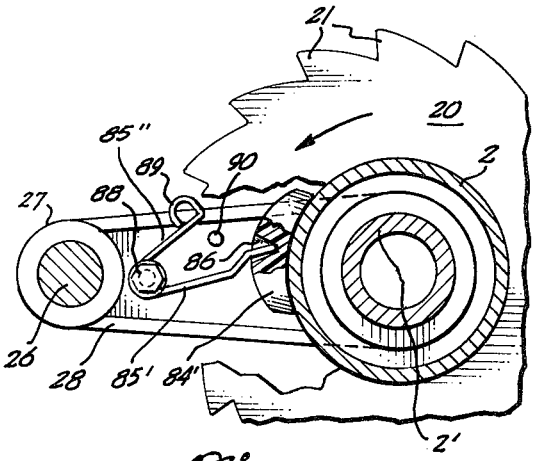
FIG. 37 is a fragmentary side elevation of portions of the winch showing the brake feature.

The end portion of the other bifurcation 85'' of the spring is formed as a loop that can be fitted over a pin 90, as shown in FIG. 38, to tension the spring. The force tending to spread the spring bifurcations will cause the bifurcation 85' engaged with the brake shoe 84' to press the shoe downward along the drum periphery as seen in FIG. 38. The socket 86 is located somewhat above a line joining cap screw 88 and the center of the drum so that such downward force exerted by the spring bifurcation 85', as well as the friction force exerted by rotation of the drum in the counterclockwise direction, as indicated by the arrow in FIG. 38, will increase the pressure of the spring bifurcation against the brake shoe and correspondingly increase the braking effect on the drum. When the drum is turned oppositely in the haul-in direction, on the contrary, whatever force is exerted on the brake shoe by the drum will tend to lift the brake shoe, increasing the distance between it and cap screw 88 and thereby automatically relieving the pressure of the brake shoe against the drum.

ADDITIONAL DETAILS

FIG. 32 shows some details of construction of the ratchet drive mechanism more clearly than shown in the assembly views of the drawings. The boss 27 on the outer end of the ratchet arm 28 has a reduced portion 91 adjacent to one end over which the aperture 92 of the drive pawl 22 fits.

Drive pawl 22 is supported on reduced portion 91 and its axial movement is limited in one direction by shoulder 91'. On the opposite side of pawl 22 is a flat shoulder 93 engageable by a chord 94 of the aperture in cam 68 that fits next to the pawl 22 and limits axial movement of such pawl in the direction away from shoulder 91'. The cam is held in place by a snap ring 95. The length of reduced portion 91 affords sufficient clearance between the cam 68 and the shoulder 91' to enable the drive pawl to rotate freely on the boss. The linear chord 94 of the aperture in cam 68 fitting the flat shoulder 93 of the boss will prevent relative rotation between the cam 68 and the arm 28.

The mounting of the over dead center spring 40 for holding the drive pawl 22 in either the solid-line operative position of FIG. 9 engaging the ratchet wheel 20 or the broken-line retracted inoperative position of that figure is shown more clearly in FIG. 32. The compression spring 40 is received in the generally triangular aperture 96 of the drive pawl. The spring encircles one end portion 97 of an angle rod, the other end portion 98 of which is fitted into an aperture of a lug 99 projecting radially from the boss 27. The end portion 97 of the angle rod is inserted slidably into a hole 100 extending through a ball 101 that is fitted into an aperture 102 of the drive pawl 22, communicating with the generally triangular aperture 96.

When the pawl 22 is in a position such that a radial plane of the ratchet arm boss 27 extending through the aperture of lug 99 substantially bisects the triangular aperture 96 of the pawl 22, the spring 40 will be in its most compressed condition. Swinging of the pawl counterclockwise as seen in FIG. 11, or clockwise in FIG. 9, will allow the spring to expand, and the spring will tend to hold the pawl in operative engagement with the ratchet wheel 10. Swinging of the pawl in the opposite direction from such centered position, that is, clockwise as seen in FIG. 11, or counterclockwise to the broken-line position of FIG. 9, will also enable the spring 40 to expand and tend to hold the pawl in the inoperative, released position.

To assemble the pawl, ratchet arm and cam with the levers 29, 42, ball 100 is inserted into aperture 102 of pawl 22 and the opposite sides of the aperture are staked to confine the ball. After placement of the compression spring on the rod leg 97, the end of such angle rod leg is inserted into the hole of such ball and the rod moved into the pawl aperture. The pawl 22 is then slid onto reduced portion 91 of ratchet arm boss 27 while angle rod arm 98 is inserted into the aperture of lug 99, cam 68 is slid onto the boss with its chord 94 engaged with flat shoulder 93, and snap ring 95 is snapped into groove 95' to secure the assembly. This ratchet arm assembly is then inserted between levers 29 and 42 so that the aperture through boss 27 is aligned with the respective lever apertures 26' and 26"; whereupon shaft 26 is moved axially through such apertures and secured in place by set screws.

MODIFIED WINCH

Figure 41:
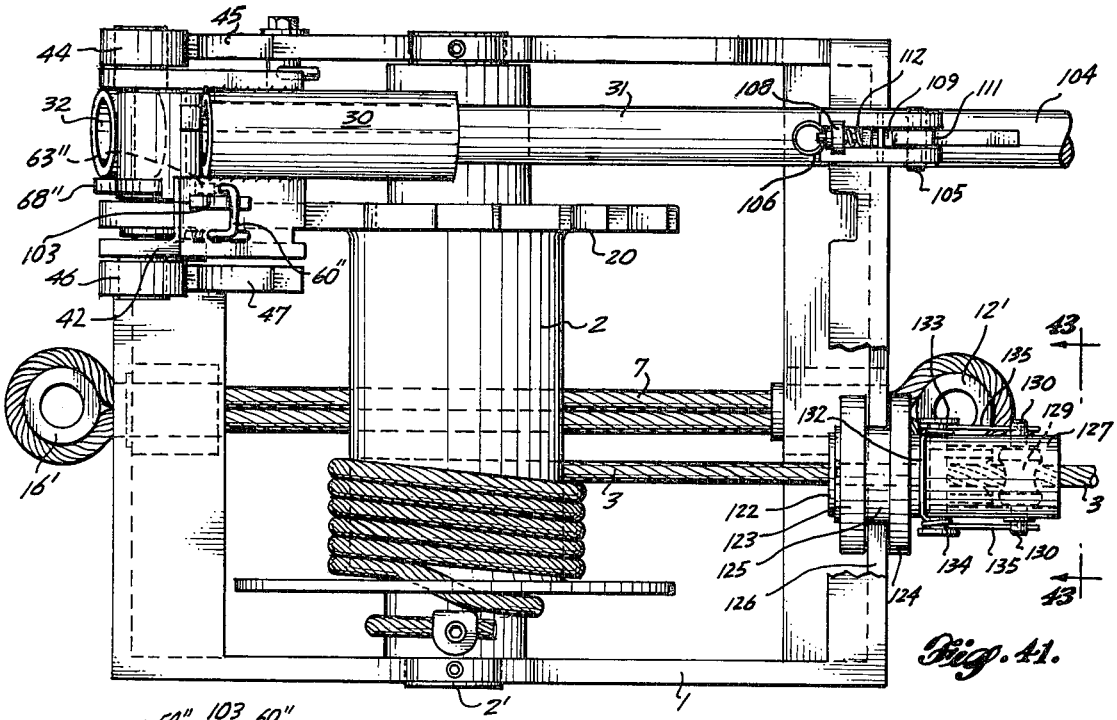
FIG. 41 is a plan and FIG. 42 is a side elevation of a somewhat modified type of the invention.
Figure 42:
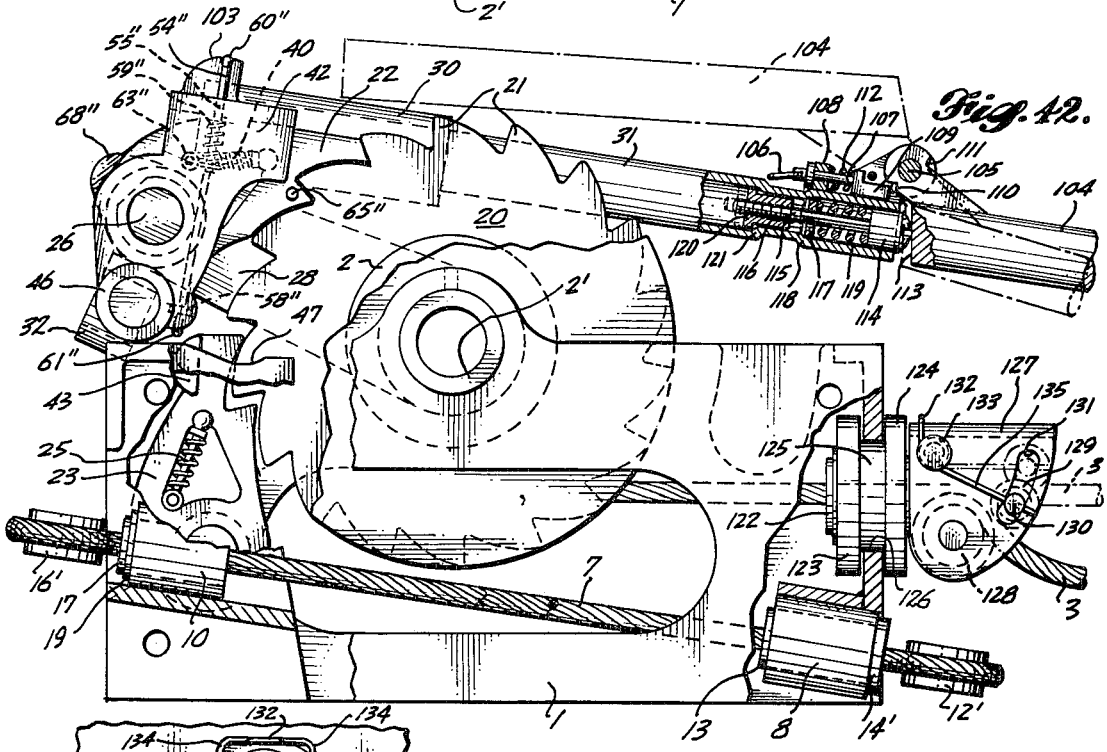
Figure 43:
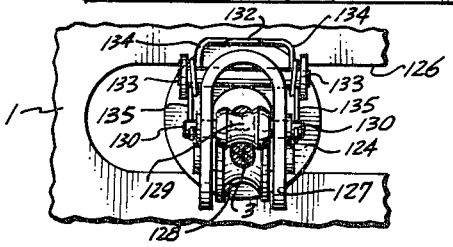
FIG. 43 is a detail elevation taken on line 43—43 of FIG. 41.

The winch shown in FIGS. 41 and 42 shows some other alternative types of mechanism. In that winch the tie 7 for anchoring the winch has somewhat different end fittings. The doubled cable, instead of being bonded to eyes at its opposite ends, extends around thimbles 12' and 16' respectively. The cables of the tie still extend through a sleeve 13 slidable into the slotted collar 8 and having a head 14', and the cables also extend through a sleeve 17 receivable in the slotted collar 10 and secured in place by the snap ring 19. The operation of the tie is the same as described in connection with FIGS. 7 and 8.

The drive mechanism for winding line 3 onto winch drum 2 and paying line out from such winch drum is generally the same as previously described, including ratchet mechanism to rotate the ratchet wheel 20 engagement with its teeth 21. Such mechanism includes the drive pawl 22 operated by swinging or pumping the handle arm 31 to effect rotation of the ratchet wheel, and the holding pawl 23 to hold the ratchet wheel against paying-out movement. The other parts of the winch mechanism are numbered correspondingly to parts of the winch previously described and operate in the same general manner.

The winch of FIGS. 41 and 42 has a somewhat modified holding pawl control mechanism. Like the pawl-control mechanism shown in FIGS. 31 and 32, such mechanism of FIGS. 41 and 42 utilizes a slidable wire 54". This wire is slidable lengthwise through apertures in guides 55"and 58". A compression spring 59" encircling the wire 54"is engaged between the guide 55" and a collar on the wire for urging such wire downward as seen in FIG. 42

The lower end of the wire 54" forms a finger 61" engageable with lug 43 on the holding pawl 23 to swing it out of engagement with teeth 21 of the ratchet wheel 20 when the handle arm 31 is swung counterclockwise as described in connection with FIGS. 24 and 25 with relation to the finger 61. Such finger is also engageable with pin 65" to swing drive pawl 22 toward the retracted inoperative position shown in FIG. 28, serving the function of engagement of roller 63 with shoulder 65 in that figure. The movement of the pawl by such finger is sufficient to enable the disengaging movement to be completed by overcenter spring 40. Such operation occurs during high-power pay-out operation of the winch. Cam lobe 68" is engageable by roller 63" carried by wire 54" to retract the wire when the direction of swing of the handle arm is reversed, so that its tip 61" can pass pin 65" and be projected again to engage the opposite side of pin 65" and swing drive pawl 22 back again into working engagement with ratchet wheel 20. When the winch is being operated in the high-speed haul-in or pay-out conditions with handle rod 31 bridging between sleeves 30 and 32 for connecting them, or when the winch is being operated in high-power, haul-in condition, the wire 54" is retracted into the position shown in FIGS. 41 and 42 so that its lower end does not project downward sufficiently to engage lug 43 of holding pawl 23. A hook 60" forming the upper end portion of the wire serves to latch wire 54" in retracted position in opposition to the force of spring 59". By pulling upward on hook 60", swinging it over a hook-retaining projection 103 projecting outward from the angle lever 42 and releasing the hook, spring 59 will urge the hook onto a notch in projection 103 thereby latching wire 54".

To promote compactness of the winch while affording substantial leverage, an extension handle 104 can be connected to the outer end of handle arm 31 by a hinge 105, as shown in FIGS. 12, 15, 16, 41 and 42. The details of the connection between the extension handle 104 and the handle arm are shown best in FIG. 42. The extension handle 104 can be swung around the axis of hinge 105 into the inoperative, broken-line position shown in the upper portion of FIG. 42.

Latch mechanism for holding the extension handle either in the solid-line position or in the upper broken-line position of FIG. 42 can be released by pulling on ring 106 extending through a hole in the end of rod 107. Such rod is slidable through an aperture in a lug 108 attached to the handle arm 31 and carries a latch block 109. Such latch block can be moved to the right, as seen in FIG. 42, for engagement in a notch 110 of the hinge part attached to the extension handle 104, so that such hinge part cannot rotate relative to the hinge part carried by handle arm 31 to enable the extension handle 104 to be swung appreciably away from the solid-line position shown in FIG. 42.

By pulling head 106 to the left, as seen in FIG. 42, away from the hinge, the latch block 109 is withdrawn from the notch 110, so that the extension handle can be swung in a counterclockwise direction into the broken-line position shown in the upper portion of FIG. 42. The hinge part attached to the extension handle 104 can have in it another notch 111 into which the latch block 109 can fit to prevent appreciable movement of the hinge part attached to the extension handle 104 relative to the hinge part attached to the handle arm 31, so that the extension handle will then be held in the folded, broken-line position. Rod 107 can extend through a helical compression spring 112 engaged between the guide lug 108 and the latch block 109 to urge such latch block to the right as seen in FIG. 42 for holding it fitted into either notch 110 or notch 111 when latch retracting force is not applied to the latch rod head 106.

Mechanism for warning the winch operator when excessive force is applied to the extension handle 104 is shown in solid lines in FIG. 42 and in broken lines in FIG. 15. In order to enable such warning mechanism to operate, the latch for the handle hinge described above must have sufficient backlash to enable the extension handle 104 to be swung relative to the handle arm 31 between the solid-line position and the broken-line position at the right of FIG. 42 when the latch block 109 is engaged in the latch notch 110. The end face 113 of the extension handle root abuts the head 114 of a rod 115, slidable received in the hollow adjacent end portion of the handle arm 31.

The rod 115 is held in the handle arm by being screwed into a nut 116. The exterior of such nut is of noncircular shape and fits a section of the handle arm 31 that is of noncircular shape so that the nut cannot rotate as the threaded portion of rod 115 is screwed into it. Such rod also extends through a washer 117 bearing on a shoulder 118 facing the extension handle 104. Rod 115 extends through a helical compression spring, one end of which is engaged with the washer 117, and the other end of which is engaged with the head 114 on rod 115. The force of such spring will press the rod 115 and its head 114 to the right as seen in FIG. 42, but such movement is limited by engagement of a shoulder 120 on nut 116 with a shoulder 121 in handle arm 31 facing away from the extension handle 104.

By engagement of a screwdriver in a slot in the end of head 114 exposed at the end of handle arm 31, the rod 115 can be screwed into the nut 116 to compress spring 119 a greater or lesser amount for setting a predetermined stress in such spring. Head 114 can be moved to the left, as seen in FIG. 42, relative to the handle arm 31 in opposition to the force of spring 119 by application of a greater or lesser force to such head depending upon the initial compression under which spring 119 is held. Such force will be applied by the end face 113 of the root portion of extension handle 104 bearing against head 114.

When force transversely of the length of the handle extension 104 is exerted on such handle extension in a direction to effect haul-in rotation of the winch drum 2, a leverage force will be exerted by the end face 113 of the handle extension on head 114. Under normal operating conditions such leverage force will be insufficient to slide head 114 appreciably to the left relative to handle arm 31 in opposition to the force exerted by compression spring 119 for which it has been preset. Appreciable movement of the extension handle 104 relative to the handle arm 31 from the solid-line position of FIG. 42 toward the broken-line position at the right of that figure will indicate that an excessive force is being applied to the extension handle and that consequently an undesirably great load is being exerted on the line 3 if the winch is being operated in its high-power condition. Such movement of the extension handle thus serves as a warning to the operator of the overload condition of winch operation.

TRAVELING FAIRLEAD

Particularly FIGS. 14, 41, 42 and 43 illustrate the traveling fairlead of the winch. Such fairlead includes a tube 122, through which the line 3 extends. Such tube carries an inner flange 123 and an outer flange 124 spaced apart to form an annular groove 125 fitting in a horizontal slot 126 in the winch frame extending parallel to the axis of the drum, as shown in FIGS. 3, 11, 15 and 16. The fairlead can swivel about the axis of tube 122 and can slide freely along the full length of such slot 126.

The outer end of tube 122 carries a folded sheet cowl 127, the fold of which is offset from and extends parallel to the axis of the passage through the tube 122. A guide roller 128 having a concave annular groove engageable with the line 3 is journaled between the sides of the cowl at a location at the side of the tube aperture 122 opposite the fold of the cowl so that its rotative axis is offset from the axis of said tube. The tangent to the point on the circumference of the roller groove bottom nearest the axis of tube 122 is aligned with a particular element of the surface forming the wall of the passage through tube 122. Consequently, a line 3 passing through the fairlead tube 122 will bear in the groove of the guide roller 128, as shown best in FIGS. 14, 42 and 43. Rotation of tube 122 about its axis will displace the guide roller 128 orbitally. A spring-pressed hold-down roller 129 is engageable with the side of the line opposite that engaged by the guide roller 128 at a location spaced outwardly from the tube 122 beyond the guide roller.

The holddown roller 129 is journaled on an axle 130, the opposite ends of which float in slots 131 in opposite sides of the cowl 127, extending transversely of the line 3. Resilient force is applied to the axle 130 toward the guide roller 128 by spring wire including a saddle portion 132 straddling the cowl 127. The spring wire is held in place by the heads 133 on opposite ends of a rod extending through the cowl and through loops 134 in the spring wire. The opposite ends 135 of the spring wire beyond the loops 134 extend alongside the opposite sides of the cowl 127 and pass through holes in the ends of axle 129 as shown best in FIGS. 41 and 42.

When the line 3 is under tension, the hold-down roller 129 will be raised against the force exerted by the spring wire, so that the line will be straight as shown in FIG. 14 if the pull is straight. If the pull on the line is slackened sufficiently, the pressure of the springs will swing the spring ends 135 downwardly and move the hold-down roller 129 toward the guide roller 128 to clamp the line between the two rollers, as shown in FIG. 42. Such holding of the line prevents flailing of the line within the winch housing. If the pull on line 3 is at an angle to the plane of the winch frame end in which slot 126 is provided, the line will bend around the guide roller 128 and the cowl 27 will swivel with tube 122 about the axis of the tube as necessary to maintain the guide roller 128 in an attitude such that the force of line 3 created by the load is exerted primarily on the bottom of the roller groove.

SIMPLIFIED FORM OF THE WINCH

FIGS. 44 to 48, inclusive, show a greatly simplified form of the winch having only components essential to the general type of winch operation described above. In this form of the device the structure is shown somewhat diagrammatically. FIGS. 44 and 45 show the winch in condition for high-speed operation, and FIGS. 46, 47 and 48 show the winch converted for high-power operation.

The winch of FIGS. 44 to 48 includes the same principal components as the winch described above, including the winch drum 2 carrying the ratchet wheel 20 having ratchet teeth 21. These ratchet teeth are engageable by the drive pawl 22 and by the holding pawl 23. The drive pawl 22 is mounted by pivot 26 on the ratchet arm 28. Ratchet arm 28 is mounted on the axle 2'; therefore, pivot 26 orbits about such axle when the ratchet arm is swung by handle 31. Holding pawl 23 is mounted by pivot 24 on the frame. These pawls are spring-pressed toward the ratchet wheel 20 by springs (not shown).

The sleeve 30 is carried by lever 42 pivoted on the ratchet arm, and receives the handle rod 31 which can interconnect such sleeve with sleeve 32 rigidly mounted on the swinging end portion of lever 28 for high-speed operation of the winch. For low-speed operation cam roller 46 mounted on the end of lever 42 opposite sleeve 30 is engageable with cam track 47 on the frame 1.

During high-speed operation of the winch the handle rod 31 will be in the position shifted to the right, as indicated by the arrow in FIG. 44, so as to bridge between and rigidly connect sleeves 30 and 32 for conjoint movement. As the handle arm 31 is swung in the clockwise direction as seen in FIG. 44, drive pawl 22 will engage teeth 21 and rotate the ratchet wheel 20 through approximately one-half a revolution to the position shown in FIG. 45. During such movement the holding pawl 23 will be wedged outwardly by teeth 21 and snapped into the throats of successive teeth, so as to be able to hold the winch drum against pay-out movement when the handle arm 31 is swung in the counterclockwise direction. After pawl 22 is swung out of engagement with teeth 21, the handle 31 can be swung counterclockwise from the position of FIG. 45 back to the position of FIG. 44 while the ratchet wheel is held by the pawl 23 preparatory to swinging of the lever arm for the next haulin stroke.

For high-power operation of the winch, the handle arm 31 is pulled outwardly far enough to withdraw its inner end from sleeve 32. The lever 42 is then free to turn relative to the ratchet arm 28. As the lever is turned relative to such ratchet arm in the position of FIG. 46, the cam roller 46 will be engaged with cam track 47. As the lever is swung from the position of FIG. 46 through the position of FIG. 47 to the position of FIG. 48, the roller and cam exert a wedging action on ratchet arm 28 to swing it through an increment of one tooth pitch while the handle arm is swung through an angle within the range of 90° to 120°.

In FIGS. 46, 47 and 48, the cam track 47 is shown as being linear. The angle of swing of handle arm 31 and lever 42 about pivot 26 relative to ratchet arm 28 should be correlated with the angle of swing of such ratchet arm about the axis of axle 2' relative to the frame 1 so that such angles of swing will be proportional to each other substantially throughout the entire movement of handle rod 31 through the positions of FIGS. 46, 47 and 48 and through the return movement. Such correlation is effected by constructing the pivot connection between lever 42 and ratchet arm 28 as an eccentric 136 so that the center of rotation of lever 42 relative to arm 28 will shift as the arm is swung relative to the lever.

The swing of ratchet arm 28 proportional to the swing of handle arm 31 is accomplished by locating the eccentric 136 so that when the radius of swing of the lever 42 is perpendicular to the line of cam 47, the eccentric has brought the pivot axis of the handle arm 31 closer to the follower rollers 46 to balance the cam action of the handle arm.

I claim:

1. In a ratchet winch including a drum for hauling a line, a frame mounting the drum for rotation, ratchet means for rotatively driving the drum relative to the frame and having a ratchet wheel, a drive pawl engageable with the ratchet wheel to drive it, a ratchet arm swingable to effect ratchet wheel rotating movement of the drive pawl, stop means engageable with the ratchet wheel to hold it against retrograde rotation and a handle arm for swinging the ratchet arm, the improvement comprising a hinge joint connecting the ratchet arm and the handle arm, and conversion means for selectively converting said hinge joint between a stiff arm condition in which the ratchet arm is swingable conjointly with the handle arm relative to the frame for effecting high-speed rotation of the drum and a pumping arm condition in which the handle arm is rockable relative to the ratchet arm about the hinge joint axis for swinging the ratchet arm incrementally relative to the frame through an angle much smaller than the angle of swing of the handle arm relative to the frame for effecting high-power rotation of the drum.

2. In the winch defined in claim 1, the handle arm in the pumping arm condition reacting from the frame for effecting incremental swinging of the ratchet arm.

3. In the winch defined in claim 1, lever means carried by the handle arm and engageable with the frame for effecting incremental swinging of the ratchet arm by swinging of the handle arm in pumping condition.

4. In the winch defined in claim 3, the lever means including cam means.

5. In the winch defined in claim 4, the cam means including a cam follower carried by the handle arm and a cam carried by the frame and engageable by said cam follower.

6. In the winch defined in claim 5, the cam follower including a roller and the cam including a track carried by the frame and engageable by said roller by swinging of the handle arm relative to the ratchet arm.

7. In the winch defined in claim 1, the conversion means including means bridging between the handle arm and the ratchet arm for preventing relative swinging of the handle arm and the ratchet arm about the axis of the hinge joint.

8. In the winch defined in claim 1, the handle arm including a handle section and a connecting section which are relatively swingable, hinge means interconnecting said two sections and resilient means interposed between said two sections resisting relative swinging of said two sections during application of force to said handle arm in a direction to effect haul-in rotation of the ratchet wheel but yieldable to enable swinging of said handle section relative to said connecting section upon application of force to said handle section exceeding a predetermined value.

9. In the winch defined in claim 1, the stop means including a holding pawl, and means movable by swinging of the handle arm relative to the frame for releasing the holding pawl from the ratchet wheel to enable the drum to rotate in the pay-out direction.

10. In the winch defined in claim 1, the stop means including a holding pawl, and means movable by swinging of the handle arm relative to the frame for moving the holding pawl from a released position to a position engaged with the ratchet wheel to hold the drum against rotation in the pay-out direction.

11. In the winch defined in claim 1, means movable by swinging of the handle arm relative to the frame for releasing the drive pawl from the ratchet wheel to enable such pawl to be moved relative to the ratchet wheel for subsequent engagement therewith to control pay-out rotation of the drum.

12. In a winch including a drum for hauling a line, a frame mounting the drum for rotation and means for rotatively driving the drum relative to the frame, the improvement comprising a tie slidably connected to the frame, bridging the frame and having one end connected to one end of the line, the other end of the line being connected to the drum and a portion of the line between its ends being connected to a load, anchor-connecting means connecting the other end of said tie to a fixed anchor remote from the frame, said tie thereby transmitting tension between such load and such anchor bypassing the frame, and frame-connecting means for connecting the frame and said tie for providing relative movement of said frame and said tie, said frame-connecting means including abutment means interengaged between the frame and said tie.

13. In the winch defined in claim 12, a slotted collar carried by the frame for reception of the tie therein by movement of the tie through the collar slot transversely of the length of the tie, and the abutment means including an enlargement on the tie abuttable by the end of said collar.

14. In the winch defined in claim 13, a second slotted collar carried by the frame at a location spaced from the first collar with the axis of said second collar in substantial alignment with the axis of the first collar, said second slotted collar also being engageable by the tie by movement thereof transversely of its length through the slot of said second collar.

15. In the winch defined in claim 14, means mounting the two slotted collars with their respective slots offset relatively circumferentially of the collars.

16. In the winch defined in claim 12, a slotted collar carried by the frame for reception of the tie therein by movement of the tie through the collar slot transversely of the length of the tie, and a sleeve encircling the tie and slidable axially into engagement between the tie and the slotted collar to prevent movement of the tie transversely of its length out of such collar through its slot.

17. In a winch including a drum for hauling a line, a frame mounting the drum for rotation relative to the frame and drive means for rotatively driving the drum relative to the frame, the improvement comprising a traveling fairlead for line to be wound on the drum including a guide tube through which the line passes, a guide roller engageable by the line and carried by said tube with its rotative axis perpendicular to the longitudinal axis of said tube, and mounting means mounting said tube for reciprocation axially of the drum as the line is wound and for rotation of said tube about its axis in all reciprocated positions to displace said guide roller orbitally about the longitudinal axis of said tube, said mounting means including an elongated slot in said frame having its length substantially parallel to the drum axis and slidably receiving said tube.

18. In a ratchet winch including a drum for hauling a line, a frame mounting the drum for rotation, ratchet means for rotatively driving the drum relative to the frame and having a ratchet wheel, a drive pawl engageable with the ratchet wheel to drive it, a ratchet arm swingable to effect ratchet wheel rotating movement of the drive pawl, means engageable with the ratchet wheel to hold it against retrograde rotation, and a handle arm for swinging the ratchet arm, the improvement comprising a tie carried by the frame and bridging the frame, means connecting said tie to a load and an anchor independently of the frame for transmitting stress between such load and such anchor bypassing the frame, a hinge joint connecting the ratchet arm and the handle arm, and conversion means for selectively converting said hinge joint between a stiff arm condition in which the ratchet arm is swingable conjointly with the handle arm relative to the frame for effecting high-speed rotation of the drum and a pumping arm condition in which the handle arm is rockable relative to the ratchet arm about the hinge joint axis for swinging the ratchet arm incrementally relative to the frame through an angle much smaller than the angle of swing of the handle arm relative to the frame for effecting high-power rotation of the drum.

19. In the winch defined in claim 17, spring-mounted hold-down means carried by the guide tube and rotatable therewith, engageable with the line for pressing it resiliently toward the guide roller in all reciprocated positions of the guide tube.

20. In a ratchet winch including a drum for hauling a line, a frame mounting the drum for rotation, ratchet means for rotatively driving the drum relative to the frame and having a ratchet wheel, a drive pawl engageable with the ratchet wheel to drive it, a ratchet arm carrying said drive pawl and swingable about the axis of the drum relative to the frame to effect ratchet wheel rotating movement of the drive pawl, and stop means engageable with the ratchet wheel to hold it against retrograde rotation, the improvement comprising a handle arm, pivot means mounting said handle arm on the ratchet arm for swinging relative to the ratchet arm about the axis of said pivot means lever means including a cam follower carried by said handle arm and a cam carried by the frame and engageable by said cam follower for effecting incremental swinging of the ratchet arm relative to the frame by swinging of said handle arm relative to the ratchet arm and the frame by pumping manipulation through an angle much greater than the angle of incremental swinging of the ratchet arm relative to the frame.

21. In the winch defined in claim 20, the cam follower including a roller and the cam including a track carried by the frame and engageable by said roller by swinging of the handle arm relative to the ratchet arm.

* * * * *

UNITED STATES PATENT OFFICE

CERTIFICATE OF CORRECTION

Patent No. 4,045,001 Dated August 30, 1977

Inventor(s) Thomas G. Harvey, Jr.

It is certified that error appears in the above-identified patent and that said Letters Patent are hereby corrected as shown below:

Title page, [56] References Cited, cancel "Ratcliss" and insert --Ratcliff--.

Column 24, line 41, insert a comma after "said pivot means".

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*